US009279435B2

(12) United States Patent
Bohringer et al.

(10) Patent No.: US 9,279,435 B2
(45) Date of Patent: Mar. 8, 2016

(54) VIBRATION-DRIVEN DROPLET TRANSPORT DEVICES

(71) Applicant: University of Washington through its Center for Commercialization, Seattle, WA (US)

(72) Inventors: Karl F. Bohringer, Seattle, WA (US); Todd Duncombe, Seattle, WA (US); James Parsons, Seattle, WA (US)

(73) Assignee: University of Washington through its Center for Communication, Seattle, WA (US)

( * ) Notice: Subject to any disclaimer, the term of this patent is extended or adjusted under 35 U.S.C. 154(b) by 104 days.

(21) Appl. No.: 14/061,625

(22) Filed: Oct. 23, 2013

(65) Prior Publication Data

US 2014/0144518 A1 May 29, 2014

Related U.S. Application Data

(63) Continuation-in-part of application No. 13/357,036, filed on Jan. 24, 2012, now abandoned, which is a continuation-in-part of application No. 12/179,397, filed on Jul. 24, 2008, now Pat. No. 8,142,168.

(Continued)

(51) Int. Cl.

| | |
|---|---|
| ***F15D 1/00*** | (2006.01) |
| ***B01L 3/00*** | (2006.01) |
| ***F04B 19/00*** | (2006.01) |

(52) U.S. Cl.

CPC ..... *F15D 1/00* (2013.01); *B01L 3/50273* (2013.01); *B01L 3/502792* (2013.01);

(Continued)

(58) Field of Classification Search

CPC ..... B01L 2300/0816; B01L 2300/088; B01L 2300/089; B01L 2300/166; B01L 2400/0406; B01L 2400/0439; B01L 2400/086; B01L 3/50273; B01L 3/502792; F04B 19/006; F15D 1/00; Y10T 137/0391; Y10T 137/2196

USPC ..... 417/53, 410.1; 137/13, 827

See application file for complete search history.

(56) References Cited

U.S. PATENT DOCUMENTS

| | | | |
|---|---|---|---|
| 2,792,894 | A | 5/1957 | Graham |
| 5,465,790 | A | 11/1995 | McClure |

(Continued)

FOREIGN PATENT DOCUMENTS

| | | | |
|---|---|---|---|
| JP | 01-185524 | A | 6/2001 |
| WO | 89/00809 | A1 | 9/1989 |

(Continued)

OTHER PUBLICATIONS

Fang et al., "3-D numerical simulation of contact angle hysteresis for microscale two phase flow," International Journal of Multiphase Flow 34 (2008) 690-705, Aug. 2007.*

(Continued)

*Primary Examiner* — Peter J Bertheaud
*Assistant Examiner* — Dominick L Plakkoottam
(74) *Attorney, Agent, or Firm* — Christensen O'Connor Johnson Kindness PLLC

(57) ABSTRACT

Methods and devices are provided for moving a droplet on an elongated track formed on a patterned surface using vibration. The elongated track includes a plurality of patterned transverse arcuate regions such that when the surface is vibrated the droplet is urged along the track as a result of an imbalance in the adhesion of a front portion of the droplet and a back portion of the droplet to the transverse arcuate regions.

34 Claims, 18 Drawing Sheets

Related U.S. Application Data

(60) Provisional application No. 61/872,476, filed on Aug. 30, 2013, provisional application No. 61/435,679, filed on Jan. 24, 2011, provisional application No. 61/031,281, filed on Feb. 25, 2008.

(52) U.S. Cl.
CPC ..... *F04B 19/006* (2013.01); *B01L 2300/088* (2013.01); *B01L 2300/089* (2013.01); *B01L 2300/0816* (2013.01); *B01L 2300/166* (2013.01); *B01L 2400/0406* (2013.01); *B01L 2400/0439* (2013.01); *B01L 2400/086* (2013.01); *Y10T 137/0391* (2015.04); *Y10T 137/2196* (2015.04)

(56) References Cited

U.S. PATENT DOCUMENTS

| | | | | |
|---|---|---|---|---|
| 5,537,851 | A | 7/1996 | Sheu | |
| 5,660,642 | A | 8/1997 | Britten | |
| 5,759,712 | A | 6/1998 | Hockaday | |
| 6,070,284 | A | 6/2000 | Garcia | |
| 6,379,929 | B1 | 4/2002 | Burns | |
| 6,412,501 | B1 | 7/2002 | Onoda | |
| 6,502,591 | B1 | 1/2003 | Scranton | |
| 6,543,156 | B2 | 4/2003 | Bergman | |
| 6,681,499 | B2 | 1/2004 | Scranton | |
| 6,720,057 | B1 | 4/2004 | Neumayr | |
| 6,726,848 | B2 | 4/2004 | Hansen | |
| 7,016,560 | B2 | 3/2006 | Ticknor | |
| 7,507,277 | B2 * | 3/2009 | Lawrence et al. | 96/108 |
| 8,142,168 | B2 | 3/2012 | Bohringer | |
| 2003/0232203 | A1 | 12/2003 | Mutlu | |
| 2005/0003737 | A1 | 1/2005 | Montierth | |
| 2005/0281682 | A1 | 12/2005 | Paxton | |
| 2006/0148267 | A1 | 7/2006 | Hansen | |
| 2009/0211645 | A1 | 8/2009 | Bohringer | |
| 2010/0129608 | A1 | 5/2010 | Low | |

FOREIGN PATENT DOCUMENTS

| | | | |
|---|---|---|---|
| WO | 03/050861 | A1 | 6/2003 |
| WO | 03/066684 | A2 | 8/2003 |
| WO | 2005/078056 | A1 | 8/2005 |

OTHER PUBLICATIONS

Fang, G., et al., "Droplet Motion on Designed Microtextured Superhydrophobic Surfaces With Tunable Wettability," Langmuir 24(20):11651-11660, Oct. 2008.

Morita, M., et al., "Macroscopic-Wetting Anisotropy on the Line-Patterned Surface of Fluoroalkylsilane Monolayers," Langmuir 21(3):911-918, Feb. 2005.

Sandre, O., et al., "Moving Droplets on Asymmetrically Structured Surfaces," Physical Review E: Statistical Physics, Plasmas, Fluids, and Related Interdisciplinary Topics 60(3):2964-2972, Sep. 1999.

Shastry, A., et al., "Directing Droplets Using Microstructured Surfaces," Langmuir 22(14):6161-6167, Jul. 2006.

Shastry, A., et al., "Engineering Surface Roughness to Manipulate Droplets in Microfluidic Systems," Proceedings of the 18th IEEE International Conference on Micro Electro Mechanical Systems (MEMS 2005), Miami Beach, Fla., Jan. 30-Feb. 3, 2005, pp. 694-697.

Shastry, A., et al., "Hydrophobic Non-Fouling Surfaces for Droplet Based Microfluidic Bioanalytical Systems," Proceedings of the 10th International Conference on Miniaturized Systems for Chemistry and Life Sciences (μTAS2006), Tokyo, Nov. 5-9, 2006, pp. 263-265.

Shastry, A., et al., "Micro-Structured Surface Ratchets for Droplet Transport," Proceedings of the 14th International Conference on Solid-State Sensors, Actuators and Microsystems, Lyon, France, Jun. 10-14, 2007, pp. 1353-1356.

Wixforth, A., et al. "Acoustic Manipulation of Small Droplets," Analytical and Bioanalytical Chemistry 379(7-8):982-991, Aug. 2004.

Zhang, J., and Y. Han, "A Topography/Chemical Composition Gradient Polystyrene Surface: Toward the Investigation of the Relationship Between Surface Wettability and Surface Structure and Chemical Composition," Langmuir 24(3):796-801, Feb. 2008.

Zhang, J., et al., "Ratchet-Induced Anisotropic Behavior of Superparamagnetic Microdroplet," Applied Physics Letters 94(14):144104-1-144104-3, Apr. 2009.

Suda, H., and S. Yamada, "Force Measurements for the Movement of a Water Drop on a Surface With a Surface Tension Gradient," Langmuir 19(3):529-531, Dec. 2002.

Sumino, Y., et al., "An Oil Droplet That Spontaneously Climbs up Stairs," Progress of Theoretical Physics Supplement 161:348-351, 2006.

Wang, Z., and K. Mukai, "Behaviors of Bubbles in Front of a Solidifying Interface," Materials Science Forum, Proceedings of the 3rd International Conference on Solidification and Gravity, Apr. 25-28, 1999, Miskolc, Hungary, vols. 329-330, pp. 139-144.

Woodward, J.T., et al., "Contact Angles on Surfaces With Mesoscopic Chemical Heterogeneity," Langmuir 16(6):2957-2961, Jan. 2007.

Yeh, F.-W., et al., "The Arrowed Surface Ratchets With Hydrophobic Parylene for Droplet Transportation," Proceedings of the 4th IEEE International Conference on Nano/Micro Engineered and Molecular Systems, Jan. 5-8, 2009, Shenzhen, China, pp. 359-362.

Young, T., "An Essay on the Cohesion of Fluids," Philosophical Transactions of the Royal Society of London 95:65-87, Jan. 1805.

Abdelgawad, M., et al., "All-Terrain Droplet Actuation," Lab on a Chip 8(5):672-677, Apr. 2008.

Ahmad Shukri, A., et al., "Ratchet Surface Droplet Transportation," Proceedings of the 13th International Conference on Miniaturized Systems for Chemistry and Life Sciences (MicroTAS 2009), Nov. 1-5, 2009, Jeju, Korea, 1379-1381.

Barahman, M., and A.M. Lyons, "Ratchetlike Slip Angle Anisotropy on Printed Superhydrophobic Surfaces," Langmuir 27(16):9902-9909, Jun. 2011.

Barthlott, W., and C. Neinhuis, "Purity of the Sacred Lotus, or Escape From Contamination in Biological Surfaces," Planta 202(1):1-8, Apr. 1997.

Bauer, H.F., and M. Chiba, "Oscillations of Captured Spherical Drop of Viscous Liquid," Journal of Sound and Vibration 285(1-2):51-71, Jul. 2005.

Berthier, J., "Theory of Wetting," in "Microdrops and Digital Microfluidics," William Andrew Publishing, Norwich, N.Y., Chap. 2, pp. 7-73, 2008.

Bico, J., and D. Quér é, "Self-Propelling Slugs," Journal of Fluid Mechanics 467(1)101-127, Sep. 2002.

Blecua, P., et al., "Line Tension Effects for Liquid Droplets on Circular Surface Domains," Langmuir 22(26):11041-11059, Nov. 2006.

Brinkmann, M., and R. Lipowsky, "Wetting Morphologies on Substrates With Striped Surface Domains," Journal of Applied Physics 92(8):4296-4306, Oct. 2002.

Brzoska, J.B., et al., "Motions of Droplets on Hydrophobic Model Surfaces Induced by Thermal Gradients," Langmuir 9(8):2220-2224, Aug. 1993.

Buguin, A., et al., "Ratchet-Like Topological Structures for the Control of Microdrops," Applied Physics A: Materials Science & Processing 75(2):207-212, Aug. 2002.

Cassie, A.B.D., and S. Baxter, "Wettability of Porous Surfaces," Transactions of the Faraday Society 40:546-551, Jan. 1944.

Chaudhury, M.K., and G.M. Whitesides, "How to Make Water Run Uphill," Science 256(5063):1539-1541, Jun. 1992.

Cho, S K., et al., "Creating, Transporting, Cutting, and Merging Liquid Droplets by Electrowetting-Based Actuation for Digital Microfluidic Circuits," Journal of Microelectromechanical Systems 12(1):70-80, Feb. 2003.

Choi, W., et al., "A Modified Cassie—Baxter Relationship to Explain Contact Angle Hysteresis and Anisotropy on Non-Wetting Textured Surfaces," Journal of Colloid and Interface Science 339(1):208-216, Nov. 2009.

Chu, K.-H., et al., "Uni-Directional Liquid Spreading on Asymmetric Nanostructured Surfaces," Nature Materials 9(5):413-417, Mar. 2010.

(56) References Cited

OTHER PUBLICATIONS

Cubaud, T., and M. Fermigier, "Advancing Contact Lines on Chemically Patterned Surfaces," Journal of Colloid and Interface Science 269(1):171-177, Jan. 2004.
Daniel, S., and M.K. Chaudhury, "Rectified Motion of Liquid Drops on Gradient Surfaces Induced by Vibration," Langmuir 18(9):3404-3407, Apr. 2002.
Darhuber, A.A., et al., "Microfluidic Actuation by Modulation of Surface Stresses," Applied Physics Letters 82(4):657-659, Jan. 2003.
Darhuber, A.A., et al., "Thermocapillary Actuation of Droplets on Chemically Patterned Surfaces by Programmable Microheater Arrays," Journal of Microelectromechanical Systems 12(6):873-879, Dec. 2003.
Dorrer, C., and J. Rühe, "Some Thoughts on Superhydrophobic Wetting," Soft Matter 5(1):51-61, Jan. 2009.
Duncombe, T.A., et al., "Controlling Liquid Drops With Texture Ratchets," Advanced Materials 24(12):1545-1550, Mar. 2012.
Duncombe, T.A., et al., "Droplet Transport on Flat Chemically Heterogeneous Surfaces via Periodic Wetting Barriers and Vibration," Proceedings of the IEEE 23rd International Conference on Micro Electro Mechanical Systems (MEMS), Jan. 24-28, 2010, Wanchai, Hong Kong, pp. 1043-1046.
Duncombe, T.A., et al., "Integrating EWOD With Surface Ratchets for Active Droplet Transport and Sorting," Proceedings of the IEEE 22nd International Conference on Micro Electro Mechanical Systems (MEMS 2009), Jan. 25-29, 2009, Sorrento, Italy, pp. 531-534.
Extrand, C.W., "Contact Angles and Hysteresis on Surfaces With Chemically Heterogeneous Islands," Langmuir 19(9):3793-3796, Mar. 2003.
Extrand, C.W., and A.N. Gent, "Retention of Liquid Drops by Solid Surfaces," Journal of Colloid and Interface Science 138(2):431-442, Sep. 1990.
Furmidge, C.G.L., "Studies at Phase Interfaces. I. The Sliding of Liquid Drops on Solid Surfaces and a Theory for Spray Retention," Journal of Colloid Science 17(4):309-324, Apr. 1962.
Gao, L., and T.J. McCarthy, "How Wenzel and Cassie Were Wrong," Langmuir 23(7):3762-3765, Feb. 2007.
Gau, H., et al., "Liquid Morphologies on Structured Surfaces: From Microchannels to Microchips," Science 283(5398):46-49, Jan. 1999.
Gibbs, J.W., "The Scientific Papers of J. Willard Gibbs, PhD., LL.D.," vol. 1, "Thermodynamics," Dover Publications, N.Y., 1961, Chap. III, "On the Equilibrium of Heterogeneous Substances," pp. 326-327.
Hancock, M.J., et al., "Bioinspired Directional Surfaces for Adhesion, Wetting, and Transport," Advanced Functional Materials 22(11):2223-2234, Jun. 2012.
Hey, M.J., and J.G. Kingston, "The Apparent Contact Angle for a Nearly Spherical Drop on a Heterogeneous Surface," Chemical Physics Letters 447(1-3):44-48, Oct. 2007.
Ichimura, K., "Light-Driven Motion of Liquids on a Photoresponsive Surface," Science 288(5471):1624-1626, Jun. 2000.
Iwamatsu, M., "Contact Angle Hysteresis of Cylindrical Drops on Chemically Heterogeneous Striped Surfaces," Journal of Colloid and Interface Science 297(2):772-777, May 2006.
Journet, C., et al., "Contact Angle Measurements on Superhydrophobic Carbon Nanotube Forests: Effect of Fluid Pressure," Europhysics Letters 71(1):104-109, Jul. 2005.
Larsen, S.T., and R. Taboryski, "A Cassie-Like Law Using Triple Phase Boundary Line Fractions for Faceted Droplets on Chemically Heterogeneous Surfaces," Langmuir 25(3):1282-1284, Jan. 2009.
Mahadevan, L., "Non-Stick Water," Nature 411(6840):895-896, Jun. 2001.
Malvadkar, n. A., et al., "An Engineered Anisotropic Nanofilm With Unidirectional Wetting Properties," Nature Materials 9(12):1023-1028, Oct. 2010.
Mugele, G.F., and J.-C. Baret, "Electrowetting: From Basics to Applications," Journal of Physics: Condensed Matter 17(28):R705—R774, Jul. 2005.
Mukai, K., and Z. Wang, "Influence of Surface Tension Gradient on the Behavior of Bubbles Near the Solidifying Interface of Water Solution," 50th International Astronautical Congress, Oct. 4-8, 1999, Amsterdam, IAF Paper No. 99-J.1.04, 9 pages.
Noblin, X., et al., "Ratchetlike Motion of a Shaken Drop," Physical Review Letters 102(19):194504-194507, May 2009.
Noblin, X., et al., "Vibrated Sessile Drops: Transition Between Pinned and Mobile Contact Line Oscillations," European Physical Journal E 14(4):395-404, Aug. 2004.
Nosonovsky, M., "On the Range of Applicability of the Wenzel and Cassie Equations," Langmuir 23(19):9919-9920, Aug. 2007.
Oliver, J.F., et al., "Resistance to Spreading of Liquids by Sharp Edges," Journal of Colloid and Interface Science 59(3):568-581, May 1977.
Ondarcuhu, T., "Total or Partial Pinning of a Droplet on a Surface With a Chemical Discontinuity," Journal de Physique II 5(2):227-241, Feb. 1995.
Ondarcuhu, T., and M. Veyssié, "Dynamics of Spreading of a Liquid Drop Across a Surface Chemical Discontinuity," Journal de Physique II 1(1):75-85, Jan. 1991.
Pollack, M.G., et al., "Electrowetting-Based Actuation of Liquid Droplets for Microfluidic Applications," Applied Physics Letters 77(11):1725-1726, Sep. 2000.
Prakash, M., et al., "Surface Tension Transport of Prey by Feeding Shorebirds: The Capillary Ratchet," Science 320(5878):931-934, May 2008.
Quéré, D "Surface Chemistry: Fakir Droplets," Nature Materials 1(1):14-15, Sep. 2002.
Shastry, a., et al., "Contact Angle Hysteresis Characterization of Textured Super-Hydrophobic Surfaces," Proceedings of the 2007 International Solid-State Sensors, Actuators and Microsystems Conference (Transducers 2007), Jun. 10-14, 2007, Lyon, France, pp. 599-602.

* cited by examiner

VIBRATION-DRIVEN DROPLET TRANSPORT DEVICES

CROSS-REFERENCES TO RELATED APPLICATIONS

This application claims the benefit of U.S. Provisional Application No. 61/872,476, filed Aug. 30, 2013. This application is also a continuation-in-part of U.S. application Ser. No. 13/357,036, filed Jan. 24, 2012, which claims the benefit of U.S. Provisional Application No. 61/435,679, filed Jan. 24, 2011, and which is a continuation-in-part of U.S. application Ser. No. 12/179,397, filed Jul. 24, 2008, now U.S. Pat. No. 8,142,168, which claims the benefit of U.S. Provisional Application No. 61/031,281, filed Feb. 25, 2008. The disclosures of each of the above-referenced patents and applications are expressly incorporated herein by reference in their entirety.

STATEMENT OF GOVERNMENT LICENSE RIGHTS

This invention was made with Government support under Contract No. ECCS 0501628 awarded by the National Science Foundation. The Government has certain rights in the invention.

BACKGROUND OF THE INVENTION

The promise of enabling time and space resolved chemistries has seen the emergence of droplet microfluidics for lab-on-chip technologies. Generally, prior art approaches to transporting droplets have been directed to creating global surface energy gradients by exploiting electrowetting/electrocapillarity, thermo-capillarity, chemistry, or texture. Prior art static global gradients, however, are limited in usefulness because they can only drive droplets over short distances and can never form a closed loop.

Despite recent advances in microfluidic manipulation of droplets, there remains the need for a simple method and apparatus for transporting droplets over a substrate. In particular, there is a need for an apparatus that can transport droplets along complex paths, including, for example, closed loops.

SUMMARY OF THE INVENTION

A novel approach is disclosed herein to transport droplets, wherein an engineered surface having periodic structures with local asymmetry rectifies local "shaking" into a net transport of droplets on the surface. This approach retains the simplicity and ease of operation of passive gradients while overcoming their limitations by making it possible to create arbitrarily long and complex droplet guide-tracks that can also form closed loops.

In one aspect, a method for moving a droplet along a predetermined path on a surface is provided. The method includes: providing a horizontal surface having an elongated track comprising a plurality of transverse arcuate projections that are sized and spaced to support a droplet in a Fakir state, wherein the droplet has a front portion; depositing the droplet on the elongated track; and vibrating the surface at a frequency and amplitude sufficient to cause the droplet to deform such that the front portion of the supported droplet contacts at least one additional transverse arcuate projection, thereby urging the droplet towards the additional transverse arcuate projection.

In another aspect, a device is provided for moving a droplet along a predetermined path on a surface, comprising: a surface having an elongated track comprising a plurality of transverse arcuate projections that are sized and spaced to support a droplet in a Fakir state, wherein the droplet has a front portion; and a means for vibrating the surface at a frequency and amplitude sufficient to cause the droplet to deform such that the front portion of the supported droplet contacts at least one additional transverse arcuate projection, thereby urging the droplet towards the additional transverse arcuate projection.

In one aspect, a method of moving a droplet along a predetermined path on a surface is provided. In one embodiment, the method includes:

providing a surface having an elongated track comprising a plurality of transverse arcuate regions having a different degree of hydrophobicity than the surface, wherein the transverse arcuate regions are sized and spaced to induce asymmetric contact angle hysteresis when the droplet is vibrated;

depositing the droplet on the elongated track; and vibrating the surface at a frequency and amplitude sufficient to cause the droplet to deform such that a front portion of the supported droplet contacts an at least one additional transverse arcuate region, thereby urging the droplet towards the at least one additional transverse arcuate region.

In another aspect, a device for moving a droplet along a predetermined path on a surface is provided. In one embodiment, the device includes:

a surface having an elongated track comprising a plurality of transverse arcuate regions having a different degree of hydrophobicity than the surface, wherein the transverse arcuate regions are sized and spaced to induce asymmetric contact angle hysteresis when the droplet is vibrated; and a means for vibrating the surface at a frequency and amplitude sufficient to cause the droplet to deform such that the front portion of the droplet contacts at least one additional transverse arcuate region, thereby urging the droplet towards the at least one additional transverse arcuate region.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 14A: The critical stage angle, α, for each track design is plotted for the rung curvature pointing uphill and downhill, respectively; FIG. 14B: The difference in α for the rung curvature uphill and downhill experiment is plotted for each track design; and FIG. 14C: Pinning anisotropy is plotted for each track design;

DETAILED DESCRIPTION OF THE INVENTION

The invention provides methods and devices for transporting droplets on a surface. The aspects provided include droplet transport schemes utilizing both textured "mesas" and flat "wetting barrier" surfaces.

Textured Surfaces

A method is disclosed for transporting droplets on a surface textured with a plurality of nested transverse arcuate projections (interchangeably referred to herein as "mesas") where the motion results from vibrating a droplet having a front portion contacting a larger area of mesa surface than the back portion of the droplet, such that the imbalance of the contacted areas propels the droplet in the direction of greater contacted surface area due to surface energy minimization. The arcuate mesas form "tracks" for the moving droplet. The energetically favored movement of the droplet is in the direction of the concave portion of the arcuate mesas. Thus, as the droplets are vibrated, they "ratchet" along the arcuate mesas tracks. The tracks can be arbitrary in length and form complex shapes, including loops. While arcuate mesas are provided, it is contemplated that other mesa shapes (e.g., v-shapes) may alternatively be useful.

In one aspect, a method for moving a droplet along a predetermined path on a surface is provided. The method includes: providing a surface having an elongated track comprising a plurality of transverse arcuate projections that are sized and spaced to support a droplet in a Fakir state, wherein the droplet has a front portion; depositing the droplet on the elongated track; and vibrating the surface at a frequency and amplitude sufficient to cause the droplet to deform such that the front portion of the supported droplet contacts and adheres to at least one additional transverse arcuate projection, thereby urging the droplet towards the additional transverse arcuate projection.

In another aspect, a device is provided for moving a droplet along a predetermined path on a surface, comprising: a surface having an elongated track comprising a plurality of transverse arcuate projections that are sized and spaced to support a droplet in a Fakir state, wherein the droplet has a front portion; and a means for vibrating the surface at a frequency and amplitude sufficient to cause the droplet to deform such that the front portion of the supported droplet contacts and adheres to at least one additional transverse arcuate projection, thereby urging the droplet towards the additional transverse arcuate projection.

Figure 1:
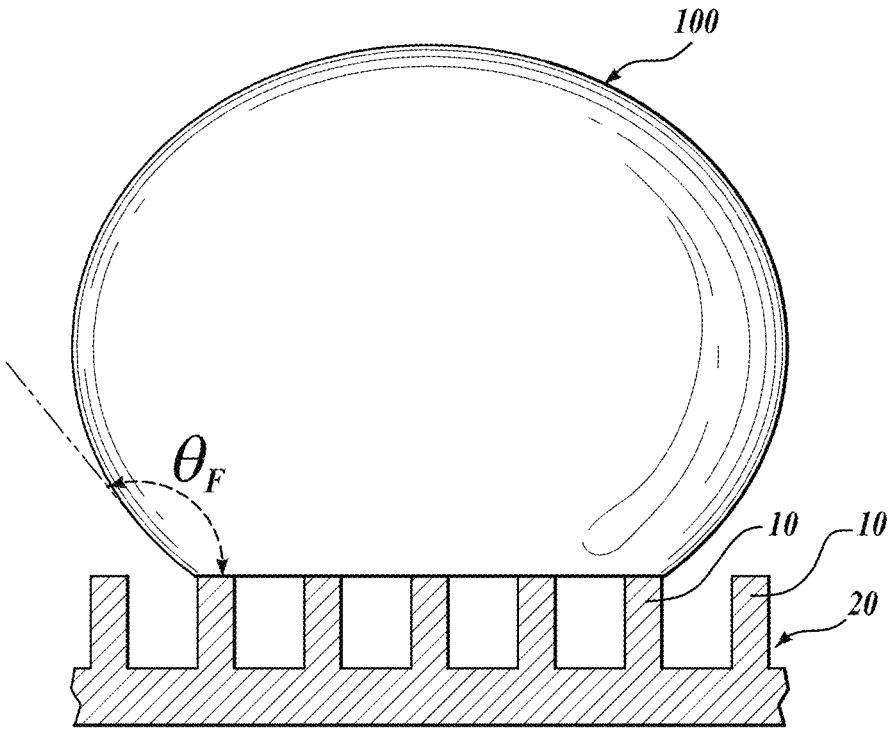
FIG. 1 is a sketch of a portion of a device in accordance with the present invention, illustrating a droplet supported in the Fakir state.

FIG. 1 shows a droplet 100 situated on a textured surfaces 20 formed in accordance with the present invention, the textured surface 20 defining a plurality of pillars 10, wherein the shape and/or the surface chemistry of the textured surface 20 and the composition of the droplet 100 allow the droplet 100 to be supported in the "Fakir" state, i.e., supported at the tops of the pillars 10. A representative droplet is a water droplet. Preferably, at least the upright or vertical portions of the pillars 10 are hydrophobic, and the pillars 10 are spaced such that the droplet 100 is supported above the pillars 10. It will be appreciated that the Fakir state is a metastable state having air pockets in the spaces between the pillars 10 below the droplet 100, and in this embodiment the surface 20 is a superhydrophobic surface. The angle $\theta_F$ represents the macroscopic contact angle between the droplet 100 and the surface 20.

Figures 2A, 2B, 2C:
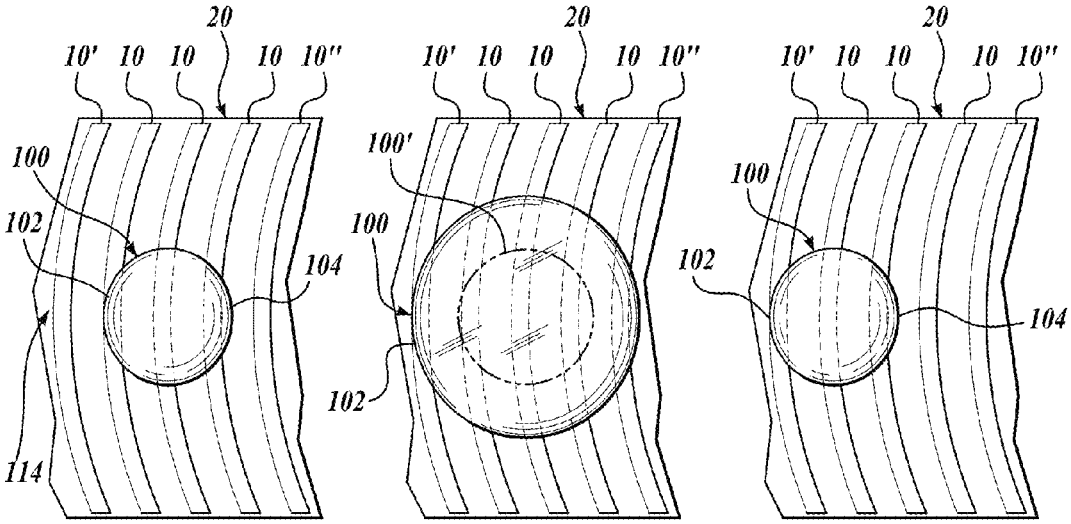
FIGS. 2A-2C are plan-view sketches of textured surfaces and droplets illustrating principles of the present invention.
Figures 2D, 2E, 2F:
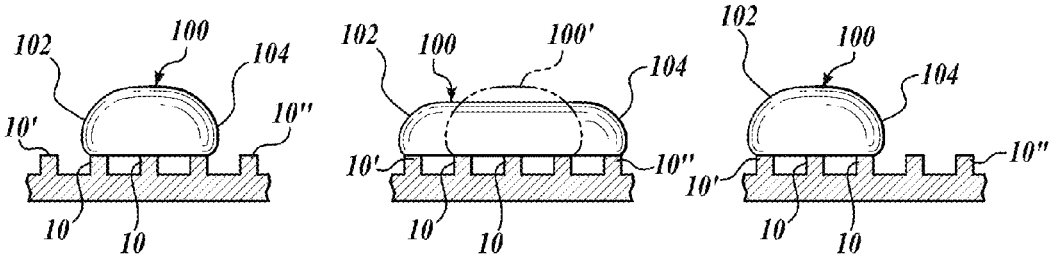
FIGS. 2D-2F are side cross-sectional sketches of the textured surfaces and droplets shown in FIGS. 2A-2C.

FIGS. 2A-2F show views of the textured surface 20 with the droplet 100, illustrating the basic principle of transport, which is illustrated in plan view in FIGS. 2A-2C and in side view in FIGS. 2D-2F. Referring now to FIG. 2A, in this embodiment the pillars 10 are formed as arcuate mesas comprising a track 114. Although unitary pillars 10 are illustrated, it is contemplated that each of the pillars 10 may alternatively comprise a plurality of spaced-apart posts that cooperatively define an intermittent arcuate mesa. The droplet 100 is supported on the mesas 10 with a front portion 102 of the droplet contacting a particular lead mesa 10, the lowest possible surface energy state for the droplet on the surface 20.

If the surface 20 is vibrated, inertial forces will cause the droplet 100 to deform. For example, during an upward portion of a vibration the droplet 100 will tend to spread out as the surface 20 pushes the bottom of the droplet 100 upwardly. Droplet deformation is illustrated in FIG. 2B, where the droplet 100 is flatter and covers a larger area than the original droplet footprint 100' (the deformation is exaggerated, for clarity). The actual shape of the deformed droplet 100 will depend on the intensity of the vibration and the properties of the droplet 100 and the surface 20. In FIG. 2B, the droplet front portion 102 extends and contacts the next forward mesa 10', and the back portion 104 contacts the next rearward mesa 10".

Because the arcuate shape of the mesa 10 curves in the same direction as the droplet front portion 102 (and opposite the curvature of the droplet back portion 104), the droplet front portion 102 contacts a larger surface area of mesa 10' than the back portion 104 contacts of mesa 10". Therefore, from surface energy and/or surface tension considerations, the droplet 100 will preferentially pin or adhere to mesa 10' at the front portion 102. Then, as the surface 20 vibration moves downwardly, inertial forces tend to cause the droplet 100 to elongate vertically, and the droplet 100 will move in the direction of the front portion 102. In one embodiment, the arcuate mesas define substantially circular arcs, the arcs having substantially similar radii to that of the droplet. If the radii of the arcuate mesas and the droplet are substantially similar, the amount of mesa-top surface area potentially contacted by the front portion of the droplet is maximized.

The droplet 100 moved by the above process is illustrated in FIG. 2C, where the front portion 102 of the droplet 100 now contacts the forward mesa 10'. Thus, as the surface 20 continues to vibrate, the droplet 100 will move, from right to left in FIGS. 2A-2C.

The movement of a droplet in the devices can be explained in terms of locally minimizing surface energy. The droplet front portion 102 tends to contact greater mesa surface area than the droplet back portion 104 because the front portion 102 curves in the same direction as the mesas 10. More surface area contacted results in minimized surface energy. As the surface 20 vibrates, the droplet 100 is deformed and the front portion 102 contacts greater surface area than the back portion 104 for a symmetrical deformation. The droplet 100 will therefore be urged to move towards the front portion 102. The vibration frequency and amplitude must be sufficient to cause the droplet 100 to extend across one or more of the gaps between arcuate mesas 10. So long as the front portion of the droplet continues to contact more surface area than other sides of the droplet, the front portion will be preferentially pinned to the new position and the droplet 100 will tend to move toward the front portion 102.

Figure 3:
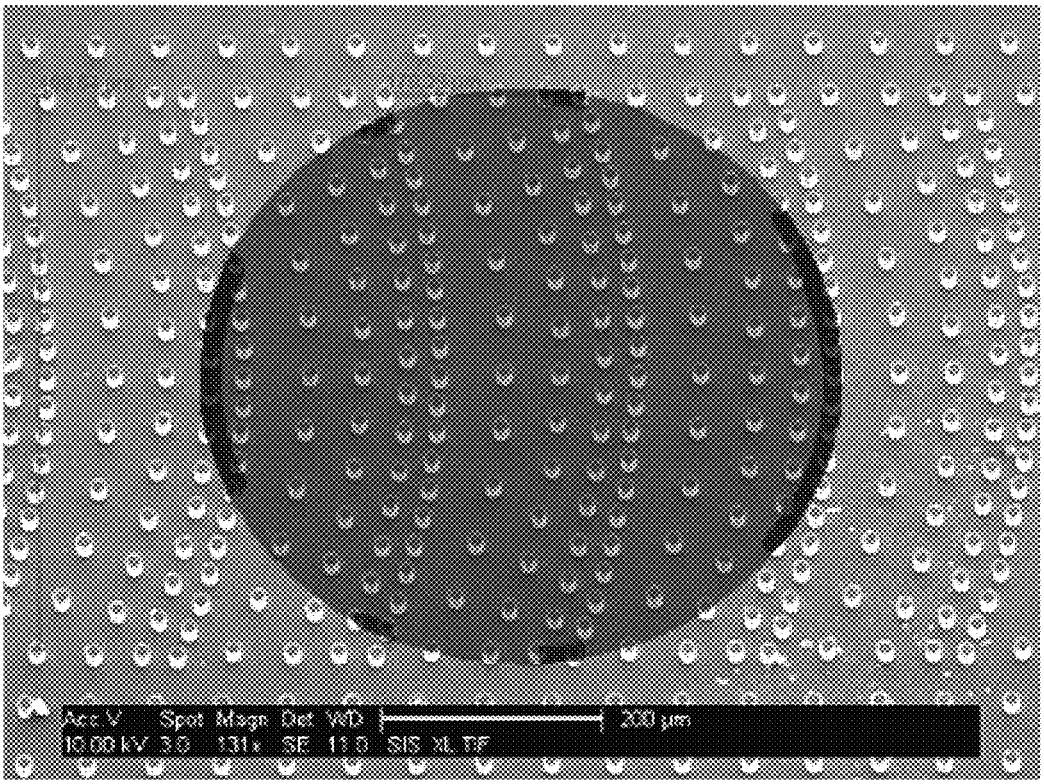
FIG. 3 is a micrograph of a textured surface in accordance with the present invention.

Referring now to FIG. 3, a micrograph of a representative textured surface is pictured. The mesas on this representative textured surface are comprised of posts positioned to define intermittent mesas in the shape of arcs and with varying density from arc to arc within a set of arcs, moving from left to right in FIG. 3. The periodic difference in arc-to-arc density is such that each arc in a set of arcs has a different linear density of posts, with the set of arcs repeating periodically.

In FIG. 3 an exemplary droplet area indicated by a dark circle (at a horizontal plane located at the top of the posts) is superimposed on the micrograph, with the darker-shaded areas of the periphery generally indicating areas of contact with the surface of the mesas. The front portion of the droplet (as illustrated, on the right-hand side of the shaded droplet area) makes contact with a larger number of posts, and thus a larger surface area, than the back portion of the droplet (on the left side of the droplet). If the exemplary substrate and droplet illustrated in FIG. 3 were vibrated, because of the energetically favorable conditions towards the right-hand side of the droplet, the droplet would move from left to right across the substrate.

Figure 4A:
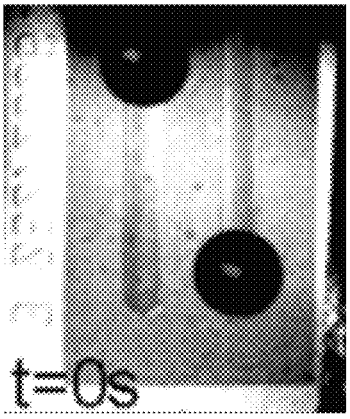
FIGS. 4A-4F are micrographs of the operation of a device in accordance with the present invention.
Figure 4B:
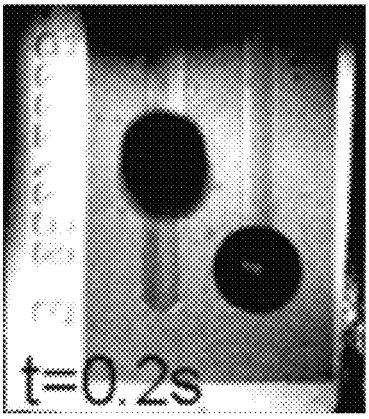
Figure 4C:
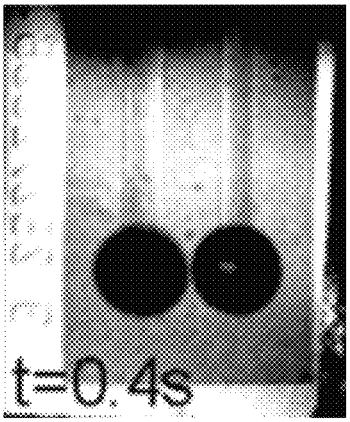
Figure 4D:
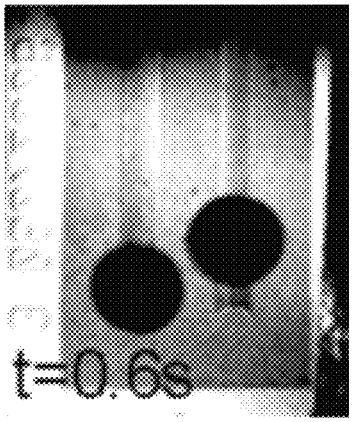
Figure 4E:
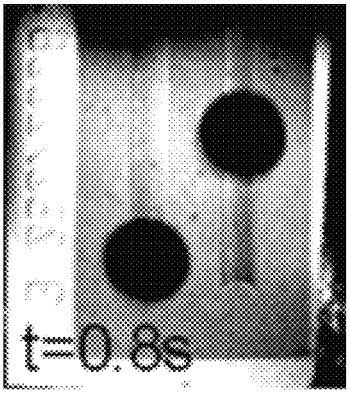
Figure 4F:
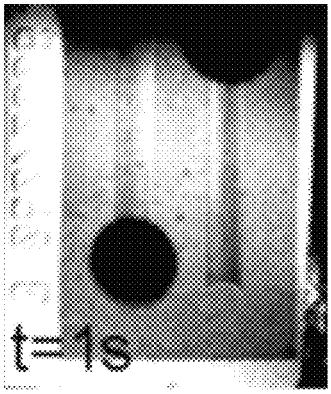

Referring now to FIGS. 4A-4F, a series of micrographs are shown that illustrate the operation of a representative device having two droplets situated upon two tracks of mesas, where the curvature of the mesas are in opposite directions (left track mesas are concave towards the top of the image, right track mesas are concave towards the bottom of the image). FIG. 4A illustrates an initial condition with both droplets at rest. As the intensity of the vibrations is increased, the smaller of the two droplets begins to move along its track, as illustrated in FIG. 4B. Maintaining a vibration intensity sufficient to move the first droplet but not the second results in the first droplet traveling to the end of its track, as illustrated in FIG. 4C. FIG. 4D illustrates the results of increasing the intensity of vibration such that the larger second droplet is induced into movement. FIG. 4E illustrates the larger droplet moving along its track and FIG. 4F illustrates the device where both droplets have moved to the end of their tracks.

Tracks useful in representative devices are not limited to linear shapes, but also include any shape that can be patterned on a surface, including looped tracks and tracks that Cross.

A device need not be strictly horizontal to function, and a droplet can be transported up (or down) an incline so long as the spacing and density of the mesas and the vibration intensity are such that it is energetically favorable for a droplet to move along the incline and remain pinned at increasingly higher locations due to energy minimization. In embodiments wherein a droplet is moved along an incline, gravitational forces must be considered. For example, when driving a droplet up an incline, the pinning force at the front portion of the droplet will be resisted by gravity.

Devices can be useful, for example, in facilitating space and time-resolved chemistries, and for the handling of chemical and biological samples that are available in low quantities or low concentration.

Theory

Although not intending to be limited by the following, the inventor's current understanding of the physical mechanism included is discussed below.

Figure 5:
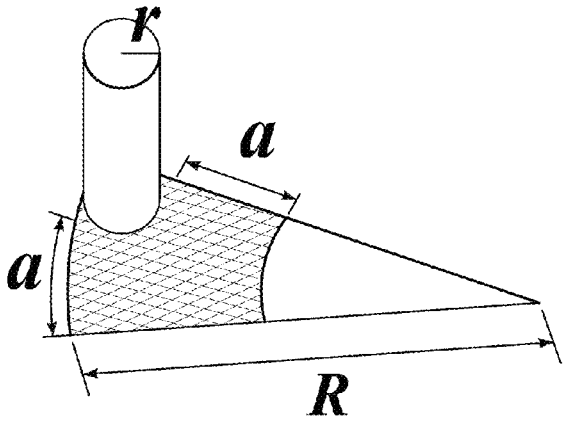
FIG. 5 is a perspective-view sketch of a mesa useful in the present invention.

As described above, representative devices operate when a droplet is in the Fakir state on a surface. The Fakir state of a droplet on a textured surface is illustrated in FIG. 1 and is the result of a particular set of surface texture parameters, as described below. A droplet on a surface has a contact angle $\theta_F$ (as illustrated in FIG. 1) when in the Fakir state as defined by Equation (1):

$$\cos\theta_F = \phi(\cos\theta_i + 1) - 1 \tag{1}$$

where $\theta_i$ is the intrinsic contact angle of the droplet on a non-textured mesa material and $\phi$ is a surface texture parameter defined by Equation (2), wherein a, r, and R are illustrated in FIG. 5 (for circular post mesas).

$$\phi = \frac{\pi r^2}{(a+2r)^2 - \frac{(a+2r)^3}{2R}} \tag{2}$$

Generally, $\phi$ is the ratio of total mesa-top surface area to total projected surface area.

Because $\phi$ is defined both by the post dimension and the spacing between posts, if the posts all have a constant surface size (e.g., cylindrical posts having uniform diameter), then the resulting $\phi$ value will increase the closer the posts are spaced from one another. An increase in $\phi$ corresponds to a decrease in surface energy and contact angle when referring to a system where a droplet is contacting the mesa tops.

A second texture parameter z can be expressed as the ratio of the total mesa surface area (including height, length, and width) to the total surface area over which the pillar and surrounding surface cover. The texture parameters $\phi$ and z can be distinguished in that z takes into account the three-dimensional surface area of the mesas while $\phi$ only concerns the mesa-top surface area.

The texture parameters $\phi$ and z are used to design textured surfaces that support droplets in the Fakir state, which is stable only if the inequality expressed in Equation (3) holds true:

$$\cos\theta_i < \frac{\phi - 1}{z - \phi} \tag{3}$$

Thus, if a particular droplet (liquid) and surface result in a fixed intrinsic contact angle ($\theta_i$), the design of the mesas of the substrate that influence z and $\phi$ allow the structure to be tailored to either support the Fakir state or the Wenzel state (full wetting of the surface).

The intrinsic contact angle $\theta_i$ is related to the apparent contact angle $\theta_F$ of a Fakir droplet on a textured surface according to Equation (1). The contact angle $\theta_F$ for representative droplets on textured surfaces include droplets having a contact angle $\theta_F$ of 90° to 180°.

The contact angle $\theta_F$ varies with the energy of the surface area contacted by the droplet and thus is influenced by the texture parameter $\phi$. As $\phi$ increases and the area contacted by the droplet increases, the contact angle decreases as a result of the reduction of the surface energy. The opposite also holds true: as $\phi$ decreases and the area contacted by the droplet decreases the surface energy increases and the contact angle formed between the droplet and the mesas increases. In representative devices, the front portion of the droplet has a smaller contact angle than the back portion because it contacts more surface area, and thus has a lower surface energy.

A Fakir droplet on a surface does not spontaneously transition to the Wenzel state because of the presence of an energy barrier. The contact angle $\theta_F$ depends only on $\phi$ and $\theta_i$ and is independent of the coating on the sidewall. However, the energy barrier between the Fakir and Wenzel states depends on the coatings of the sidewall and is independent of the $\theta_i$ of the mesa tops (according to Equation (3)). Thus, the size and surface chemistry of both the mesa tops and sidewalls are important for devices of the invention.

As described above, during device operation the droplet moves as the result of pinning Pinning refers to the force between a portion of the droplet and the surface it touches. An advancing droplet is a droplet that is flattened such that it is reduced in height and increased in radius (in the plane of the substrate; assuming a symmetric vibrational mode shape), and a receding droplet is the opposite: the droplet is increased in height and reduced in surface area radius. Thus, a vibrating droplet will first advance, such that the droplet is compressed and spread out, and then will recede.

There is an asymmetry in the behavior of different portions of advancing and receding droplets, which drives the movement of droplets in representative devices. The degree of pinning of a portion of a droplet is based on the texture parameter $\phi$, with a low $\phi$ resulting in: a high contact angle $\theta_F$, a low degree of pinning in the advancing direction, and a low degree of pinning in the receding direction. A high $\phi$ (i.e., larger surface area) results in: a lower contact angle $\theta_F$, low pinning when advancing, and high pinning in the receding direction. This asymmetry in receding pinning forces results in movement towards an area of high $\phi$ if there is an asymmetry in the $\phi$ parameter between front and back portions of the droplet when vibrating. Because an area of high $\phi$ has a high degree of receding pinning, the pinned portion will remain in the high $\phi$ (low surface energy) area while the low $\phi$ area will not pin the opposite portion of the droplet, and thus the droplet is allowed to move towards a higher $\phi$ area.

Representative arcuate mesa structures are surrounded by a low-$\phi$ region that serves to repel the droplets, thus tending to retain the droplets on the arcuate mesa tracks. The $\phi$ of this region is significantly smaller than that of the track, so as to contain the droplets, but the pillars are not so sparse that the droplets sag down between them. In an exemplary embodiment, the $\phi$ of this region is less than or equal to 0.04.

Vibration

Devices operate through the vibration of droplets on a textured surface. The means for supplying the vibration is not specifically important and any techniques for generating vibration known to those of skill in the art are useful. In a representative embodiment, the vibration of the droplet is vertical (perpendicular to the substrate) and acoustically induced by a speaker driven by an amplifier. Alternatively, modal exciters (such as the Bruel & Kjaer 4808) and piezo actuators are exemplary means for providing vibration. Non-perpendicular vibration can be useful, for example, to produce asymmetric vibrations that may act (sometimes in conjunction with surface features) to produce droplet switches, for example, where tracks intersect and a droplet is directed along a selected path by the angle (relative to the substrate) of the vibration.

The frequency and intensity of vibration needed to move a droplet depends on the size of the droplet and the energy considerations related to the textured surface. In a representative, non-limiting, embodiment, a micron-sized droplet can be transported across a textured surface with a vibration frequency of from about 1 to about 100 Hz.

Devices

Figure 6A:
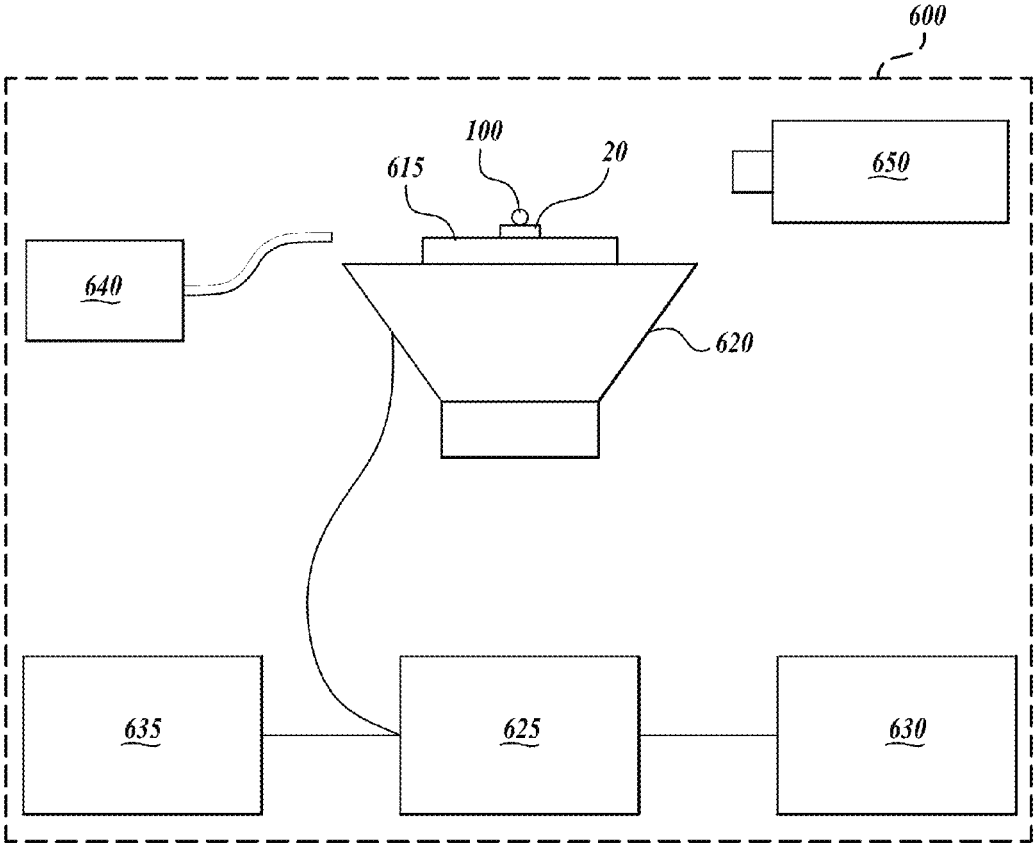
FIG. 6A is a diagram of a system for operating a device in accordance with the present invention.

An exemplary system 600 in accordance with the present invention is illustrated in FIG. 6A. The droplet 100 is disposed on the surface of the textured substrate 20, as previously described. The substrate 20 is mounted on a positionable stage 615. The stage 615 is mounted on a source for vibration 620, such as a speaker. The vibration source 620 is driven by an amplifier 625 that can also in turn be driven by a waveform generator 630 and the signal generated by the amplifier 625 can be monitored using an oscilloscope 635. The droplet 100 is recorded and contact angles are measured using a high-intensity light source 640 directed across the droplet 100 and into a high-speed camera 650. The results of a typical device of the invention operating have been previously described in conjunction with FIG. 4.

Additionally, as will be appreciated by those of skill in the art, the motion of a droplet can be measured using, for example, a laser vibrometer or a built-in accelerometer.

The devices are useful as a tool for transporting droplets to and from locations on a substrate where the droplets can be analyzed or manipulated by techniques known to those of skill in the art. Representative analytical techniques include passive analyses, such as microscopy, and destructive analyses, such as GC/MS.

Figure 6B:
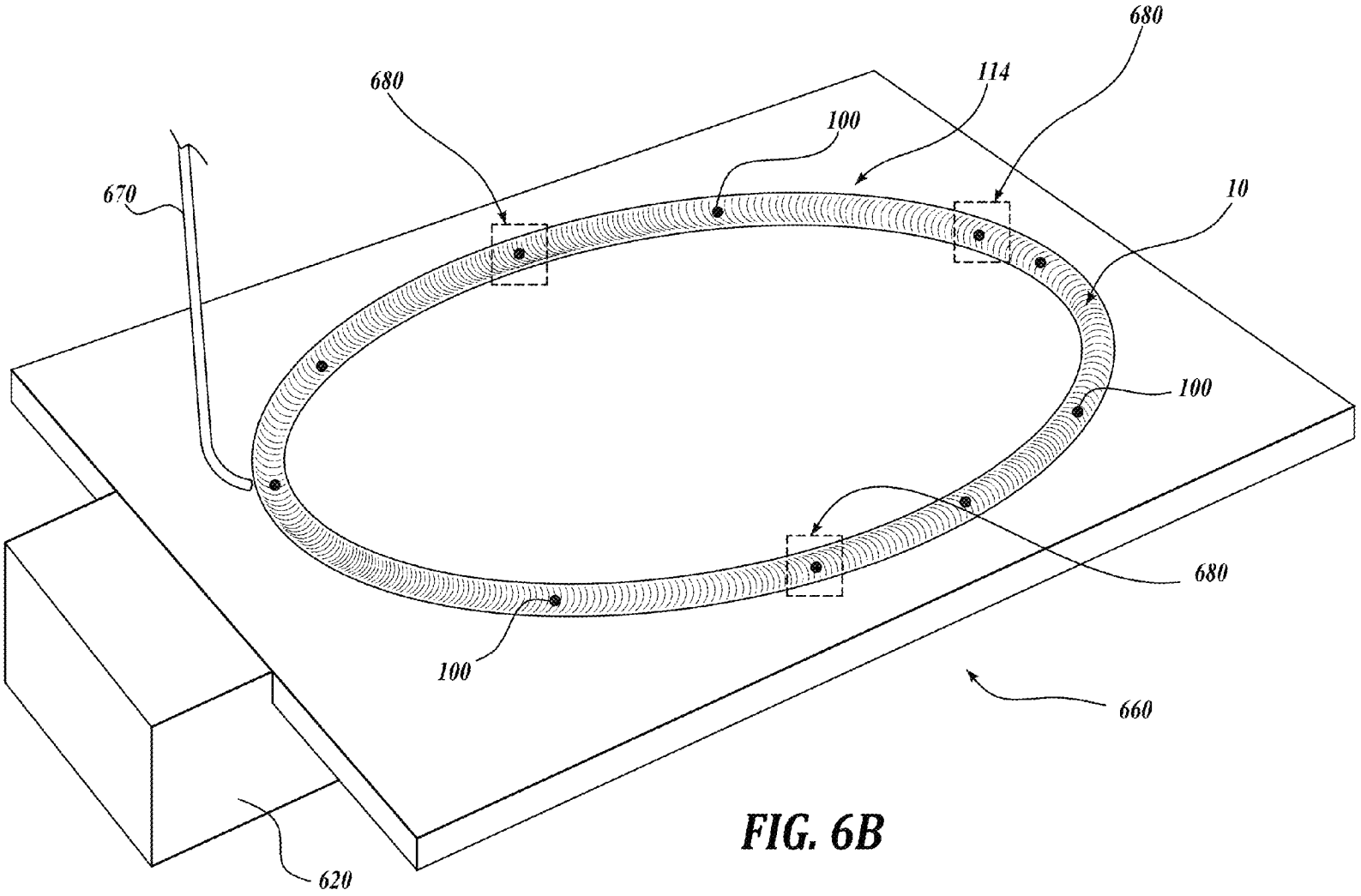
FIG. 6B is a sketch of a system for operating a device in accordance with the present invention.

An exemplary device 660 incorporating a loop-shaped track 114 of arcuate mesas 10 is sketched in FIG. 6B. Droplets 100 are supplied by a means for depositing droplets 670, which are moved along the track 114 in a counter-clockwise direction as the device 660 is vibrated by the means for vibration 620. In this exemplary device 660, the droplets 100 can be analyzed by up to three analytical techniques 680 (each of which can be the same or different from the others), such as fluorescence microscopy, as the droplet 100 moves in a loop around the track 114. By traveling in a loop, the droplet 100 can be analyzed by several analytical techniques 680. It will be appreciated that analytical techniques 680 useful in analyzing droplets 100 are known to those of skill in the art.

Textured Surface Fabrication

Textured surfaces can be fabricated using techniques known to those of skill in the art. Surfaces can be made from a range of materials (e.g., semiconductors or polymers), with the only limitation on available materials being the ability of the material to form a surface that will support a droplet in the Fakir state. Traditional semiconductor microfabrication techniques, including photolithography, thin film deposition, and etching techniques, can be used to fabricate devices of the invention, as can other techniques (e.g., molding, soft lithography, and nanoimprint lithography). Any fabrication technique is useful if it can produce the appropriate mesa structures (having the appropriate surface chemistry) for creating the Fakir state of a droplet.

Figure 7A:
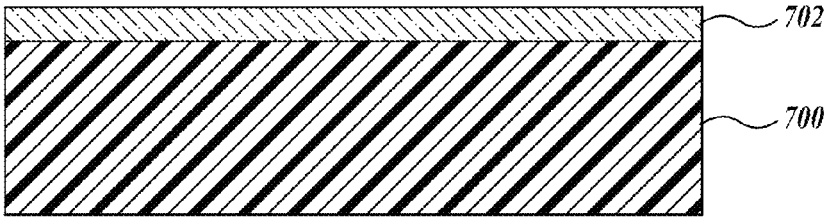
FIGS. 7A-7D illustrate the stages of the fabrication of a representative surface useful in devices in accordance with the present invention.
Figure 7B:
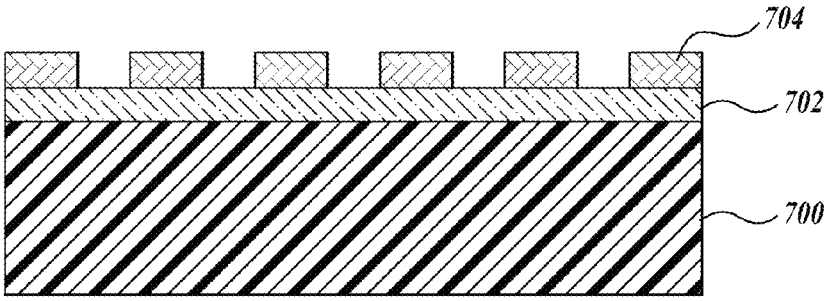

Referring now to FIGS. 7A-7D, a representative textured surface fabrication process, is illustrated using traditional microfabrication techniques. This exemplary fabrication process begins in FIG. 7A with a silicon substrate 700 having a thin oxide 702 deposited or grown on the surface. The shapes of the mesas are defined first through the use of lithography, wherein the areas that will become mesa tops are masked with photoresist 704 that is deposited and patterned on the oxide 702, as illustrated in FIG. 7B.

Figure 7C:
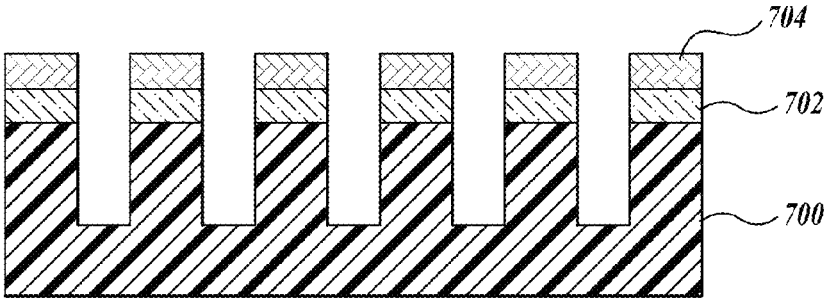
Figure 7D:
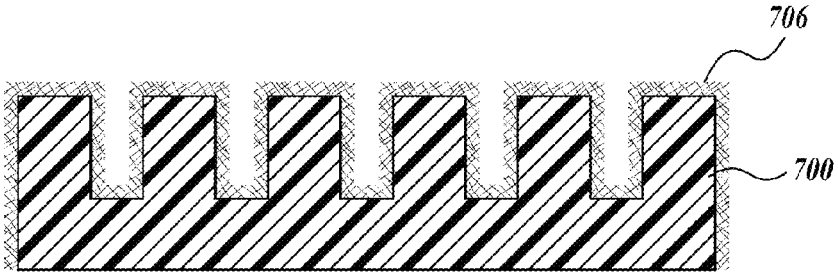

In this exemplary process, two different etching stages are performed to define the mesa height, with the resulting structure illustrated in FIG. 7C. The first etching step is a standard oxide etch (e.g., buffered oxide etch) that removes the oxide 702 that is not protected by the patterned photoresist 704. The unetched oxide 702 and the photoresist 704 both serve as etch barriers so as to mask the silicon 700 for deep reactive ion etching (DRIE) that results in the final structure illustrated in FIG. 7C. The oxide 702 and photoresist 704 are removed from the silicon 700 and a hydrophobic thin film 706 is deposited (e.g., by solution, vapor, or plasma) on the silicon 700, covering the tops, side walls, and trenches between the mesas, resulting in the structure illustrated in FIG. 7D. It will be appreciated that other techniques, such as soft lithographic processing (including micromolding and embossing) of hydrophobic polymers (e.g., PDMS), can yield similar structures as those described above; however, the mesas are then made entirely of the intrinsically hydrophobic material. Further treatment of such hydrophobic polymers can alter the hydrophobicity of portions of the structure (e.g., the tops of the mesas can be treated to become hydrophilic).

As described previously, the Fakir state is primarily a result of the hydrophobicity of the sidewalls of the mesas, although the tops of the mesas also contribute to the overall hydrophobic effects of the substrate. In one embodiment, the tops of the mesas are hydrophilic and the sidewalls of the mesas are hydrophobic.

Exemplary Device Results

An exemplary device includes round post-shaped mesas having diameters of 20 microns, the posts being shaped into arcs nested with other arcs. An exemplary structure illustrating this design is pictured in the micrograph of FIG. 3. The curvature of the rows of mesas is typically varied from 0.5 mm to 1 mm in this exemplary embodiment. The height of mesas in this exemplary embodiment is 25 microns and the droplets range in size from 5 μl to 15 μl. Droplets can be dispensed using methods known to those of skill in the art, including manually dispensing droplets with a syringe.

Figure 8:
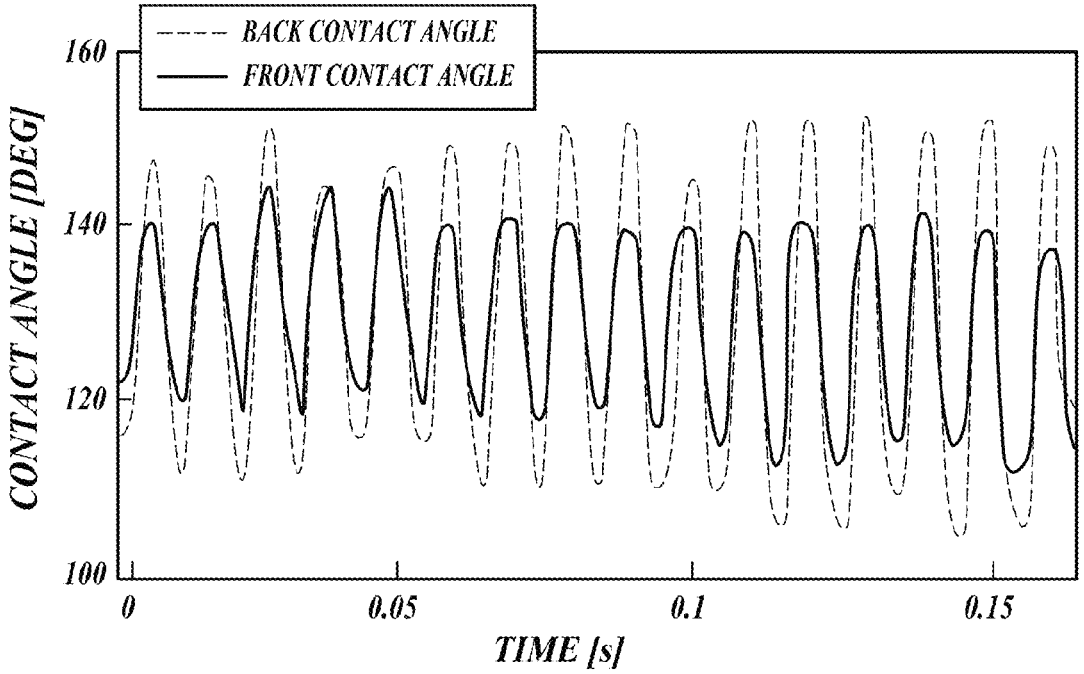
FIG. 8 is a graphical analysis of the operation of a device in accordance with the present invention.
Figure 9:
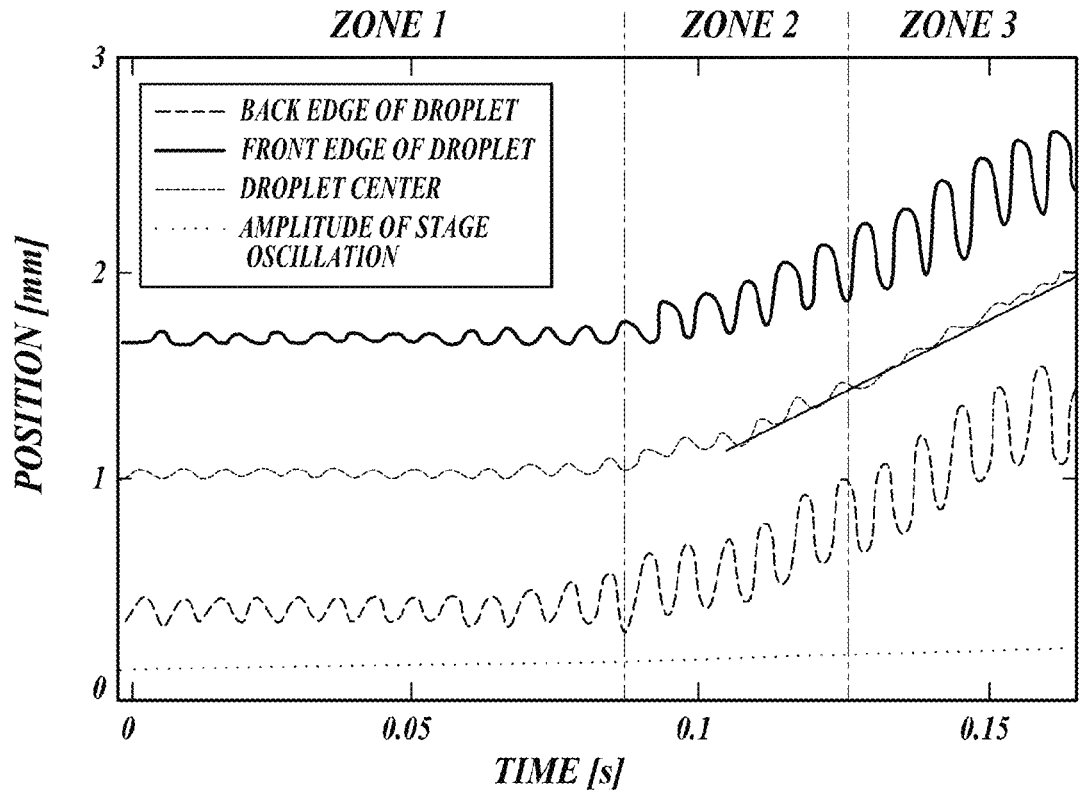
FIG. 9 is a graphical analysis of the operation of a device in accordance with the present invention.

Graphical analyses of devices of the invention are shown in FIGS. 8 and 9. FIG. 8 graphically depicts the oscillations of both the front and back portions of a vibrating droplet with respect to contact angle. In each cycle, the portions advance outward when the droplet is compressed and recede inward when the droplet is recessed. The peaks correspond to advancing angles and the troughs to receding angles. The smaller amplitude of oscillations at the front portion (the portion that is curved in the same direction as the mesas) is a direct consequence of the higher pinning that is experienced as the front portion encounters more surface area of mesas, and thus lower surface energy.

Referring now to FIG. 9, the position of a droplet is graphically depicted as the amplitude of vibration increases. With an increase in amplitude of vibration, the energy coupled into the droplet increases. In zone 1 of FIG. 9, the vibration energy is small and the droplet remains "stuck" to the surface. In zone 1, the footprint of the droplet remains constant. In zone 2, the front and back portions begin to oscillate but the energy supplied to the droplet is comparable to that dissipated in movement of the portions. Because the portions begin to oscillate, the droplet begins to translate, resulting in motion in the direction of minimized surface energy. In zone 3, the energy supplied by vibrations is high, such that the droplet begins to jump. However, the time spent when the droplet is off contact is dead time. Hence, the vibration-induced movement efficiency drops in zone 3, and movement is reduced. Thus, the advantage of high amplitudes of oscillation is reduced by the ineffective movement of droplets that are removed from the surface for a period of time as the result of strong vibrations.

In the exemplary device graphically analyzed in FIG. 9, a maximum rate of travel of a droplet vibrated on the surface is 12.5 mm/s. The terminal velocity is illustrated in FIG. 9 by the solid line drawn through the droplet-center plot. In zone 2 of FIG. 9, the droplet begins accelerating, but the acceleration peaks at 12.5 mm/s because, as vibration intensity is increased and the droplet enters zone 3, the portions of the droplet may extend further in the plane of the surface but the droplet leaving the surface for short amounts of time results in decreased efficiency of movement, and thus a terminal velocity is reached. The exemplary system used to generate the graphs of FIG. 8 and FIG. 9 includes a water droplet and a substrate as described in conjunction with FIG. 7, where the substrate comprises a silicon substrate having circular mesas etched into the surface and coated with fluorinated octyl trichlorosilane. The substrate and droplet system are vibrated in this example by a speaker driven at 49 Hz with a square wave. The droplet size is about 10 μl.

Flat Surfaces

As discussed above, textured devices ("texture ratchets") can be used to move a droplet suspended on the textured pattern in the Fakir state. As a result of the semi-circular rung design, there is near-continuous pinning for the side of the drop aligned with the rung curvature but only intermittent pinning for the anti-aligned side. The asymmetry in pinning results in unbalanced contact angle hysteresis. That is, when vibrated, the aligned side exhibits a greater range of contact angles over time per vibration cycle than the anti-aligned side for the same time and cycle and thus, the hysteresis of the aligned side is greater than the hysteresis of the anti-aligned side. When sufficiently agitated by vertical vibration, the contact line of the drop will de-pin to cyclically advance and recede. Asymmetry in contact angle hysteresis rectifies footprint oscillations into controlled horizontal transport, specifically, in the direction of the rung curvature, or, greater contact angle hysteresis.

Texture ratchets capitalize on strong pinning at geometric barriers, but they are inherently limited by the nature of rough surfaces. At extreme vibrations the drop can collapse from the Fakir state into the microstructure and become immobilized in the Wenzel state. In addition, aspect-ratio fabrication constraints limit the minimal ratchet period length achievable on a microstructured surface. Fully transparent texture ratchets are impossible to realize. The fabrication protocols required for a rough surface limit the concurrent fabrication and integration of electrodes and sensors.

Transparent ratchet devices on a flat surface can be designed using principles similar to the texture ratchets.

In one aspect, a method of moving a droplet along a predetermined path on a surface is provided. In one embodiment, the method includes:

providing a surface having an elongated track comprising a plurality of transverse arcuate regions having a different degree of hydrophobicity than the surface, wherein the transverse arcuate regions are sized and spaced to induce asymmetric contact angle hysteresis when the droplet is vibrated;

depositing the droplet on the elongated track; and vibrating the surface at a frequency and amplitude sufficient to cause the droplet to deform such that a front portion of the supported droplet contacts an at least one additional transverse arcuate region, thereby urging the droplet towards the at least one additional transverse arcuate region.

In another aspect, a device for moving a droplet along a predetermined path on a surface is provided. In one embodiment, the device includes:

a surface having an elongated track comprising a plurality of transverse arcuate regions having a different degree of hydrophobicity than the surface, wherein the transverse arcuate regions are sized and spaced to induce asymmetric contact angle hysteresis when the droplet is vibrated; and a means for vibrating the surface at a frequency and amplitude sufficient to cause the droplet to deform such that the front portion of the droplet contacts at least one additional transverse arcuate region, thereby urging the droplet towards the at least one additional transverse arcuate region.

In the flat surface embodiments, the flat devices operate using vibration and edge pinning of the droplet on an elongated track formed from a plurality of arcuate features. For the textured devices, the elongated track is formed from a plurality of arcuate projections ("mesas") that extend from the surface of the substrate, as described above. Conversely, flat devices do not have arcuate projections, but instead have a surface patterned with an elongated track formed from a plurality of transverse arcuate regions having a different degree of hydrophobicity than the surface. This hydrophobic-hydrophilic patterning is referred to herein as a "wetting barrier" ratchet track. The track supports a droplet along an alternating pattern defined by regions having a different degree of hydrophobicity. As used herein, the term "different degree of hydrophobicity" is used to describe surfaces that have a different affinity for water, which is used as the benchmark droplet liquid. The substrate and the arcuate regions may both be hydrophobic, they may both be hydrophilic, or one may be hydrophobic and the other may be hydrophilic. In one embodiment, the plurality of transverse arcuate regions are more hydrophobic than the surface. In one embodiment, the plurality of transverse arcuate regions are more hydrophilic than the surface.

Modification of surfaces to form hydrophobic or hydrophilic functionalities is well known to those of skill in the art. Chemical modifications (e.g., using self-assembled monolayers) or thin-film depositions (e.g., chemical vapor deposition) are exemplary methods. Any means can be used to form the transverse arcuate projections as long as the method used can form the necessary patterned regions in the shape of the elongated track with sufficient precision so as to allow the track to support a droplet and allow for movement of the droplet along the track when sufficiently vibrated.

The droplet is a liquid supported by the elongated track according to the description herein. The droplet may be hydrophobic (e.g., an organic solvent) or hydrophilic (e.g., water).

The droplet has a degree of hydrophobicity such that it is supported as a droplet on the substrate and the arcuate regions and there is an asymmetry in how each side of the droplet experiences the substrate/arcuate region interface, thus inducing asymmetric contact angle hysteresis during vibration.

In one embodiment, the droplet has a degree of hydrophobicity closer to the degree of hydrophobicity of the transverse arcuate regions than that of the surface. The hydrophobicity of the droplet, arcuate regions, and the surface are all defined such that the droplet has a degree of hydrophobicity closer to the degree of hydrophobicity of the transverse arcuate regions than that of the surface. Because the droplet has affinity for the arcuate regions, the edge-pinning effect occurs, which allows for transport of the droplet across the track when vibrated.

In other embodiments, the degree of hydrophobicity of the droplet is closer to the degree of hydrophobicity of the surface than that of the transverse arcuate regions. In such embodiments, the affinity of the droplets to the substrate and the arcuate regions still supports the droplet and creates an asymmetry in how each side of the droplet experiences the substrate/arcuate region interface, thus inducing asymmetric contact angle hysteresis during vibration.

As with the texture ratchets, the transverse arcuate regions are sized and spaced to induce asymmetric contact angle hysteresis when the droplet is vibrated. The step of vibrating the surface at a frequency and amplitude sufficient to cause the droplet to deform such that a front portion of the supported droplet contacts an at least one additional transverse arcuate region, thereby urging the droplet towards the at least one additional transverse arcuate region operates in a similar manner as disclosed above with regard to texture ratchets, although a theoretical description is also provided below.

Figure 10A:
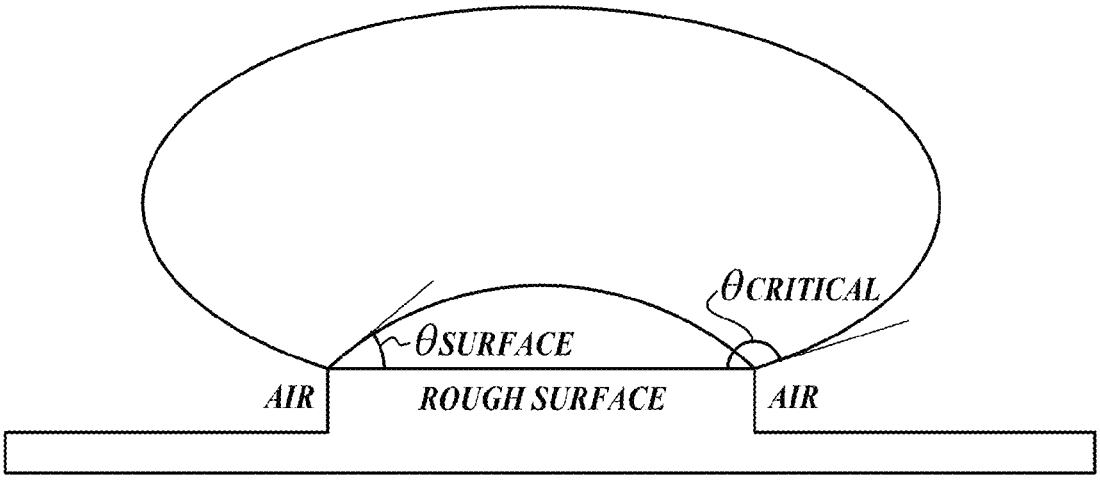
FIG. 10A is a schematic side elevation view illustration of a droplet with edges pinned to a textured surface.
Figure 10B:
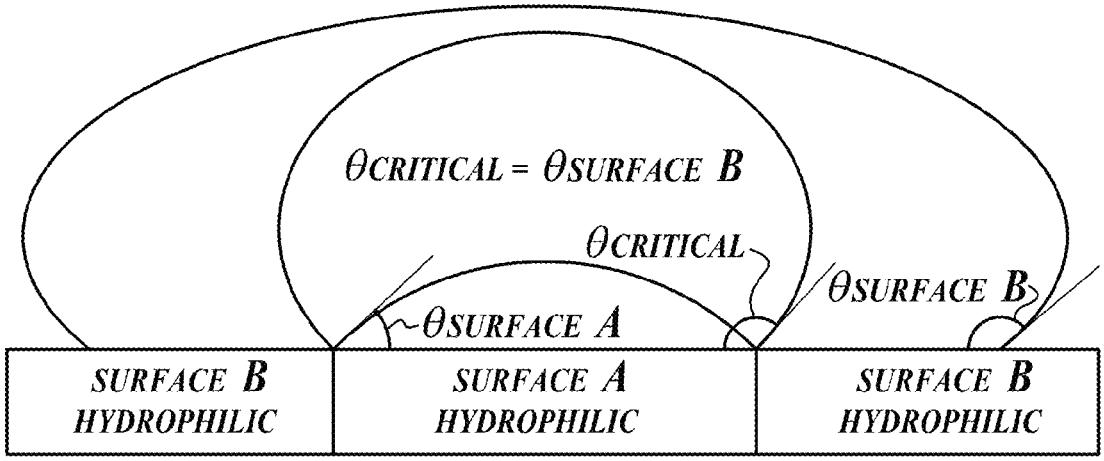
FIG. 10B is a schematic side elevation view illustration of a droplet with edges pinned to a mixed hydrophobic-hydrophilic flat surface, in accordance with the disclosed embodiments.

A comparison of how water pins to a sharp edge and to a wetting barrier is shown in FIGS. 10A and 10B. FIG. 10A illustrates water's strong pinning to sharp edges, which is a well known phenomenon; it is commonly demonstrated by the ability of a drinking glass with sharp rims to hold more water than its volume. The edge sustains much larger contact angles than the characteristic wetting contact angle of the surface ($\theta_{Surface}$). At some critical angle ($\theta_{Critical}$) the droplet will collapse outwards. Referring to FIG. 10B, pinning also occurs at wetting barriers, when water spreads from a hydrophilic ($\theta_{Surface\ A}$) to a more hydrophobic surface ($\theta_{Surface\ B}$). In this case, the critical angle at wetting barriers corresponds to the characteristic wetting contact angle of the hydrophobic surface.

In one embodiment, the plurality of transverse arcuate regions and the surface are optically flat. "Optically flat" means that any step between the surface of the substrate and the arcuate regions is invisible to the eye (i.e., is significantly less than the wavelength of light (in the tens of nanometers, approximately).

In one embodiment, the plurality of transverse arcuate regions and the surface are coplanar. "Coplanar" means that there is no step at all.

In one embodiment, the plurality of transverse arcuate regions and the surface are formed from the same substrate. In such an embodiment, the surface and the arcuate regions are both formed from the same bulk material. To provide the contrast in hydrophobicity, one or both of the surface and arcuate regions are treated or coated. For example, in one embodiment the surface is untreated substrate material and the arcuate regions are chemically treated or coated to provide distinct hydrophobicity and form the elongated ratchet track.

Regarding the vibration of the surface, any combination of amplitude and frequency sufficient to move the droplet along the track is contemplated. In one embodiment, the amplitude is from 1 micron to 1 mm. In one embodiment, the frequency is from 1 Hz to 1 kHz. Flat devices typically require smaller amplitude to operate than textured devices. That is, for similar geometry devices, a flat device will move a droplet at a lower threshold amplitude than a textured device.

The elongated track can take any shape. The track shapes and functions discussed above with regard to the textured devices are applicable for flat devices. In one embodiment, the elongated track defines a closed loop. In one embodiment the track includes at least one turn. In one embodiment the track splits from a single track into two or more tracks. In one embodiment the track includes a merge of two or more tracks into a single track.

The source of vibration can be any means of vibration. The sources of vibration disclosed above for the textured devices apply to the flat devices. In one embodiment, the step of vibrating the surface comprises a technique selected from the group consisting of acoustic vibration, electromagnetic vibration, and piezoelectric vibration.

The shapes of the transverse arcuate regions are similar to those described above with regard to textured devices. In one embodiment, the transverse arcuate regions have a track width (lateral width from side to side of the track) from 1 micron to 50 mm. In one embodiment, the transverse arcuate regions have a track width from 10 microns to 10 mm.

In one embodiment, the transverse arcuate regions have a region width ("rung width"; width of each rung measured in the longitudinal track direction) from 1 nm to 1 mm. In one embodiment, the transverse arcuate regions have a region width from 100 nm to 100 microns.

In one embodiment, the transverse arcuate regions have a period ("rung period"; longitudinal track distance from the start of one rung to the start of the next rung) from 1 nm to 1 mm. In one embodiment, the transverse arcuate regions have a period from 100 nm to 100 microns.

In one embodiment, the transverse arcuate regions define substantially circular arcs having a constant radius. In one embodiment, the transverse arcuate regions define substantially circular arcs having a varying radius, (e.g., an portion of an ellipse).

In one embodiment, the constant radius is approximately equal to a radius of a footprint of the droplet.

In one embodiment, the substantially circular arcs are equal to or less than ½ of a circle.

In one embodiment, the radius of the substantially circular arcs is half of the track width or more.

In one embodiment, the step of depositing the droplet on the elongated track occurs without any external vibration. That is, the droplet can be deposited on the track prior to applying vibration. Conversely, in one embodiment, the droplet is placed on the track when vibration is applied.

In one embodiment, the step of depositing the droplet on the elongated track occurs via condensation on the elongated track. Droplets are typically deposited on the track in liquid form, although any means of providing the droplet on the track is contemplated, including condensation.

In one embodiment, the plurality of transverse arcuate regions and the surface are transparent at visible wavelengths. As noted above, it is impossible to form textured surface ratchets that are transparent because the height of the mesas introduce visible discontinuities. Because flat ratchets have no height difference between the surface and the arcuate regions, transparent devices are possible. In such embodiments if both the surface and the arcuate regions are transparent materials than the device will be transparent. Transparent devices are desirable for facile integration with microscopy (e.g., inverted epi-fluorescence). Additional benefits can be found in the potential for seamless integration onto windows or displays such as an automobile or an electronic display.

Theory

When a drop is placed on a flat chemically homogeneous surface the contact angle at the three-phase boundary can be characterized by the Young-Dupré equation. However, this equation does not hold if the triple line (TPL) coincides with a wetting discontinuity, where a range of contact angles can be established. Pinning is observed as a contact angle hysteresis, i.e., as the difference between the apparent advancing ($\theta_A$) and receding contact angles ($\theta_R$). The metastable state of a liquid on geometric discontinuities was first considered by Gibbs and later experimentally confirmed by Oliver et al. More recently, a similar effect was described at chemical discontinuities between regions of varying wettability. For our purposes, it is useful to define a hysteresis force ($F_{Hys}$) as the difference between the pinning force at the TPL for the advancing and receding state:

$$F_{Hys}=w\gamma(\cos\theta_R-\cos\theta_A) \tag{4}$$

where w is the width of the drop projected orthogonally to the direction of pinning, and $\gamma$ is the solid-liquid surface tension. By using this projection, we effectively extract the component of the force vector $F_{Hys}$ in one direction of pinning. For a drop placed on a heterogeneous surface the classic Cassie-Baxter (CB) equation predicts the apparent contact angle by an area weighted average of the cosines of the material contact angles. Recently, several papers have pointed out the limitations of the CB equation for surfaces with non-uniform pinning at the TPL and proposed modified CB equations. We use the line fraction modified CB equation, which enables a simple and intuitive means for describing our system. When a drop is placed on the device, fractions of the TPL lie on the hydrophilic region, the hydrophobic region and the boundary between the two wettabilities. The portion of the TPL at the boundary accounts for the majority of hysteresis, as its local contact angle ($\theta_b$) can vary between the equilibrium contact angles of the two materials before it de-pins ($\theta_1<\theta_b<\theta_2$). Using the line fraction method we can relate the apparent contact angle to the alignment of the TPL on a heterogeneous surface:

$$\cos\theta_{app}=X_1\cos\theta_1+X_2\cos\theta_2+X_b\cos\theta_b \tag{5}$$

where $\theta_{app}$, $\theta_1$ and $\theta_2$, and $\theta_b$ are the apparent contact angle, the equilibrium contact angles for the hydrophilic and hydrophobic materials, and the contact angle at the boundary. The line fraction $X_i$ is the proportion of the TPL length on the given materials or along the boundary projected orthogonally to the direction of pinning, such that $X_1+X_2+X_b=1$. To solve for $\cos\theta_R$ and $\cos\theta_A$ from Equation 5 we assume recession occurs when $\theta_b=\theta_1$ and advancement when $\theta_b=\theta_2$. The results are substituted into Equation 4 to derive the direct relationship between the force of pinning to the boundary line fraction $X_b$ and the difference in the contact angle cosines of the two surfaces.

$$F_{Hys}=X_b w\gamma(\cos\theta_1-\cos\theta_2) \tag{6}$$

Figure 11A:
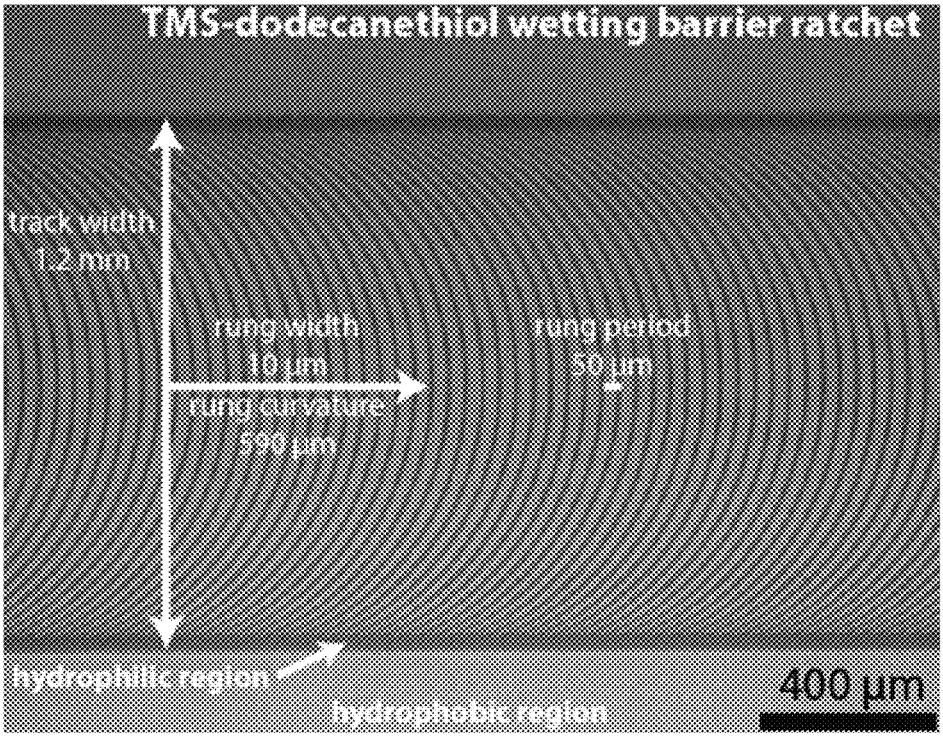
FIG. 11A is an annotated micrograph of a mixed hydrophobic-hydrophilic flat surface, in accordance with the disclosed embodiments.
Figure 11B:
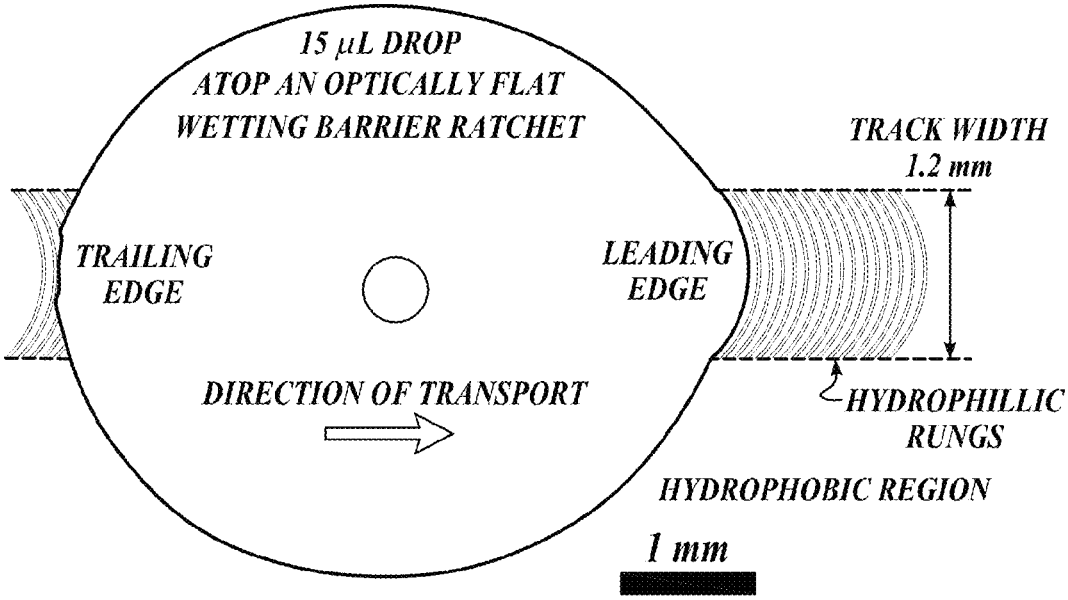
FIG. 11B is a schematic top plan view illustration of a droplet with edges pinned to a mixed hydrophobic-hydrophilic flat surface, in accordance with the disclosed embodiments.
Figure 11D:
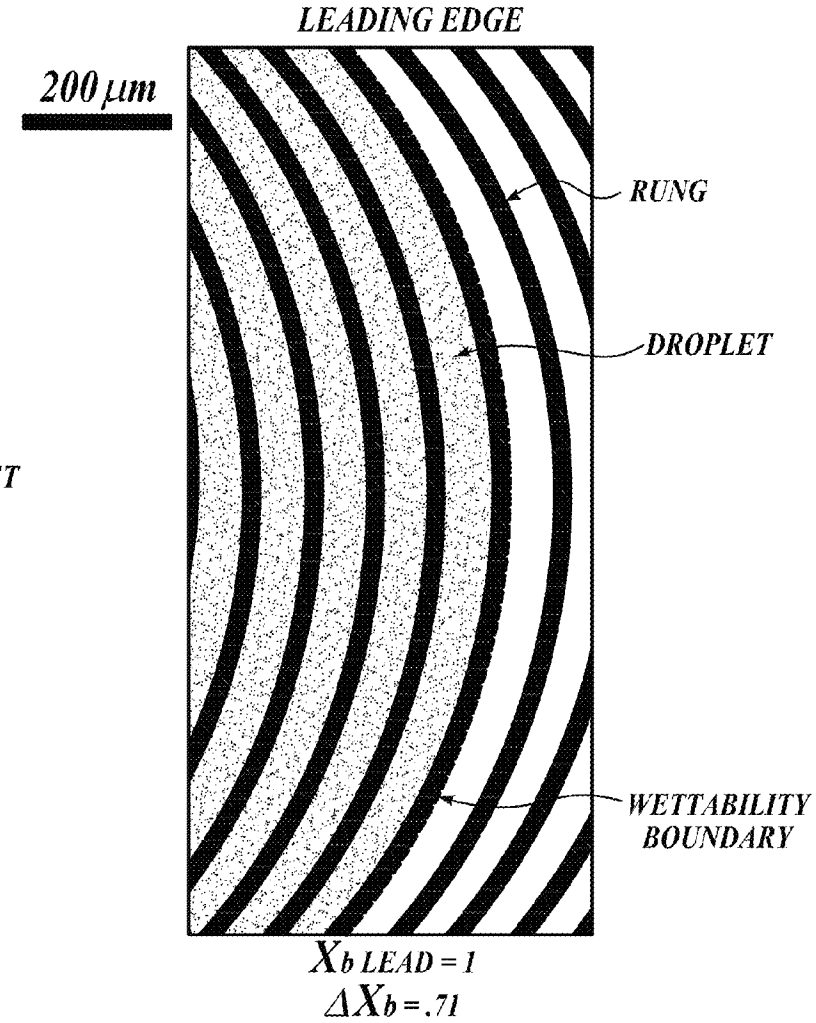
FIG. 11D is a schematic top plan view illustration of a portion of the leading edge of a droplet with edges pinned to a mixed hydrophobic-hydrophilic flat surface, in accordance with the disclosed embodiments.
Figure 11C:
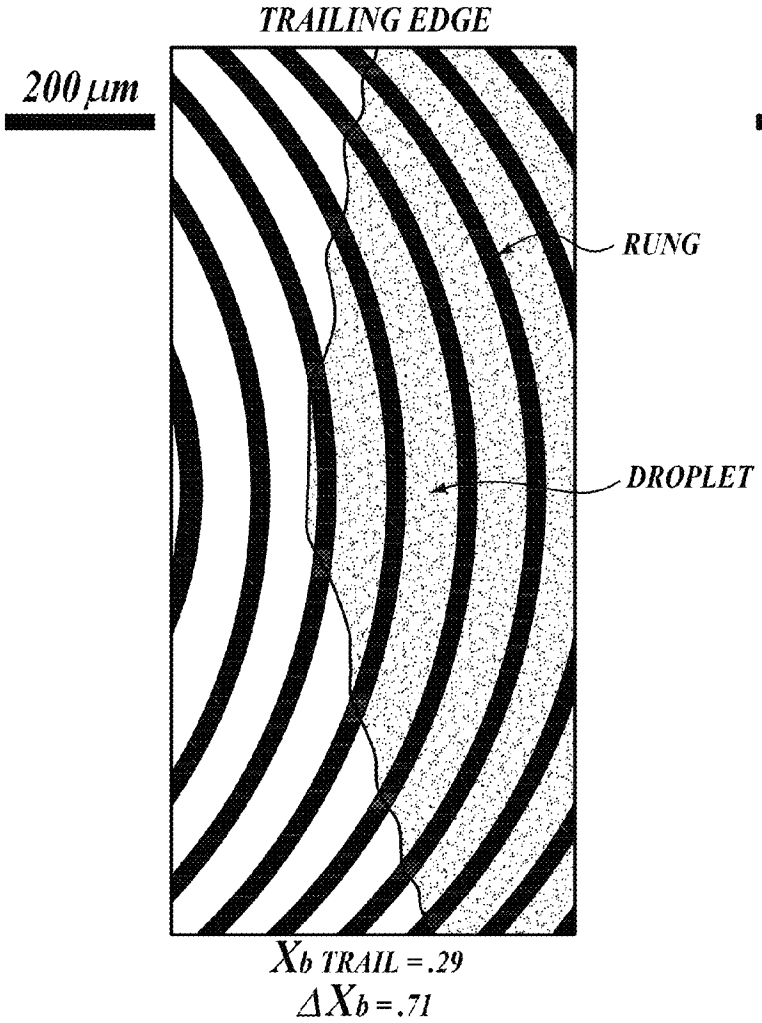
FIG. 11C is a schematic top plan view illustration of a portion of the trailing edge of a droplet with edges pinned to a mixed hydrophobic-hydrophilic flat surface, in accordance with the disclosed embodiments.

On a ratchet utilizing periodic curved rungs as its pawl, an asymmetric boundary line fraction is established between the portion of the drop edge aligned with the curvature, and the portion of the drop edge that is anti-aligned with the curvature of the rungs (FIG. 11C). We denote the former as the leading edge (high $X_b$) and the latter as the trailing edge (low $X_b$) of the drop. The effectiveness of the ratchet in converting orthogonal perturbations to anisotropic drop motion is related to relative hysteresis of the leading and trailing edges (Equation 7). This can be found by considering the difference in hysteresis force between the leading and trailing edges of a drop.

$$F_{Anisotropy}=(X_{b,Lead}-X_{b,Trail})w\gamma(\cos\theta_1-\cos\theta_2) \quad (7)$$

This equation provides a useful design principle for optimizing performance. Surfaces that maximize the boundary line fraction along the leading edge while minimizing the boundary line fraction along the trailing edge will produce the greatest anisotropy and ratcheting performance. The boundary line fractions $X_{b,Lead}$ and $X_{b,Trail}$ are determined by the complex interaction between a drop and a ratchet design—rung period, rung width, track width, rung curvature, and surface hydrophobicity in addition to drop volume, surface tension, and position on the track all play a critical role.

FIGS. 11A-11D show wetting barrier ratchets transport drops using periodic semi-circular hydrophilic rungs on a hydrophobic background. FIG. 11A: TMS-dodecanethiol wetting barrier ratchet. Dark regions correspond to the hydrophilic TMS rungs and lighter areas to the hydrophobic dodecanethiol self-assembled on Au. FIG. 11B: A sessile drop sits on an optically flat TMS-FOTS wetting barrier ratchet. FIGS. 11C and D: For visualization purposes, we overlay photos from the edges of a receding drop with the CAD mask design of the wettability pattern. FIG. 11D illustrates the right (leading) edge of the drop conforms to rung curvature while FIG. 11C illustrates the left (trailing) edge that crosses several rungs. The resulting asymmetric pinning is estimated by examining the portion of the TPL which lies at the hydrophilic-hydrophobic boundary. For the leading edge 100 percent of the TPL reside at the boundary between the hydrophilic-hydrophobic regions, while for the trailing edge only 29 percent do.

Flat Device Fabrication

To realize a ratchet on a flat surface, we chemically patterned hydrophilic regions (contact angle $\theta_1$) on a hydrophobic background (contact angle $\theta_2$) with $\theta_1<\theta_2$. In contrast to geometric discontinuities in texture ratchets, the wetting barrier ratchet utilizes a periodic, semi-circular, chemically heterogeneous pattern to induce asymmetric contact angle hysteresis. We report two surface modification techniques using both oxide and gold-adhering self-assembled monolayers (SAMs) to pattern the wettability of a surface. Trimethylsilanol (TMS)-dodecanethiol and TMS-perfluorooctyltrichlorosilane (FOTS) ratchets have been generated. Observations regarding the performance between texture ratchets and wetting barrier ratchets, including the role of rung curvature in establishing asymmetry and ratcheting performance, are disclosed herein.

We present two techniques for surface chemistry modification. One device has a chemically patterned surface of TMS (53° air-water contact angle) and dodecanethiol SAM (104° air-water contact angle). The other has a TMS and FOTS (108° air-water contact angle) patterned surface. For both processes, the silicon wafer was rinsed with acetone, isopropanol, and deionized water. The wafer was then coated with a liquid film of hexamethyldisilazane adhesion primer and allowed to react for 20 seconds before being spun dry. The result is a monolayer of TMS on the wafer surface. Photolithography was then performed with 1.2 μm of AZ1512 photoresist. After development, the remaining photoresist forms the pattern of the ratchet's rungs. An oxygen plasma treatment at 40 W for 5 minutes removes the exposed TMS (the area not covered with photoresist), revealing a bare silicon oxide layer. At this point the fabrication sequences of the two devices diverge.

For the TMS-FOTS ratchet, the next step was a chemical vapor deposition of FOTS in a standard desiccator using a house vacuum for 1 hour. Afterwards, the FOTS was annealed by placing the device on a hot plate for 1 hour at 150° C. to create covalent siloxane bonds. In the final step, the photoresist was removed with acetone revealing a TMS-FOTS pattern.

For the TMS-dodecanethiol ratchet, the next step was an evaporation of 50 nm Au onto the surface, with a 10 nm Cr adhesion layer. Liftoff was then performed. The device was then immersed into a 1:4 dodecanethiol:ethanol (by volume) bath for 1 hour to allow the dodecanethiol to assemble on the Au surface.

Experimental Setup

The experimental setup consisted of an Agilent 33120A function/arbitrary waveform generator, Brüel & Kjær Type 2718 power amplifier, Brüel & Kjær Type 4809 vibration exciter, Agilent Infiniium oscilloscope, Polytec OFV vibrometer, DRS Data & Imaging Systems Inc. Lightning RTD high-speed camera and Matlab on a Windows PC. A die with the wetting barrier ratchet was attached on the vibration exciter such that the die was horizontal and the vibration acted in the vertical direction. Drops of deionized water were pipetted onto the ratchet.

Droplet Transport

A 12.5 μL drop on the TMS-FOTS ratchet was transported at 5.4 mm/s when agitated with a vibrational agitation of 100 μm at 72 Hz. A high-speed camera captured the silhouette of the drop at 1 ms intervals and several frames from one period of oscillation are displayed in FIG. 12A. The contact angle was measured for eight stage vibration cycles, and the average and standard deviation for each time point was determined (FIG. 12B). Drop transport can be broken down into two distinct phases—footprint expansion and contraction. In the expansion phase, the accelerating stage causes the footprint to expand, effectively increasing the interfacial energy of the drop. Due to the asymmetric pinning of the rungs at the TPL the leading and trailing edges move differently, expanding 118±34 μm and 397±41 μm, respectively. In the contraction phase, the TPL of the drop recedes to minimize its interfacial energy. Similar to expansion, recession proceeds asymmetrically with the leading and trailing edges receding 58±34 μm and 455±25 μm, respectively. The key to drop transport is that the difference in leading and trailing edge recession is greater than the difference in leading and trailing edge expansion. Therefore in one vibrational cycle the drop is transported on average 60 μm in the direction of the leading edge.

Figure 12A:
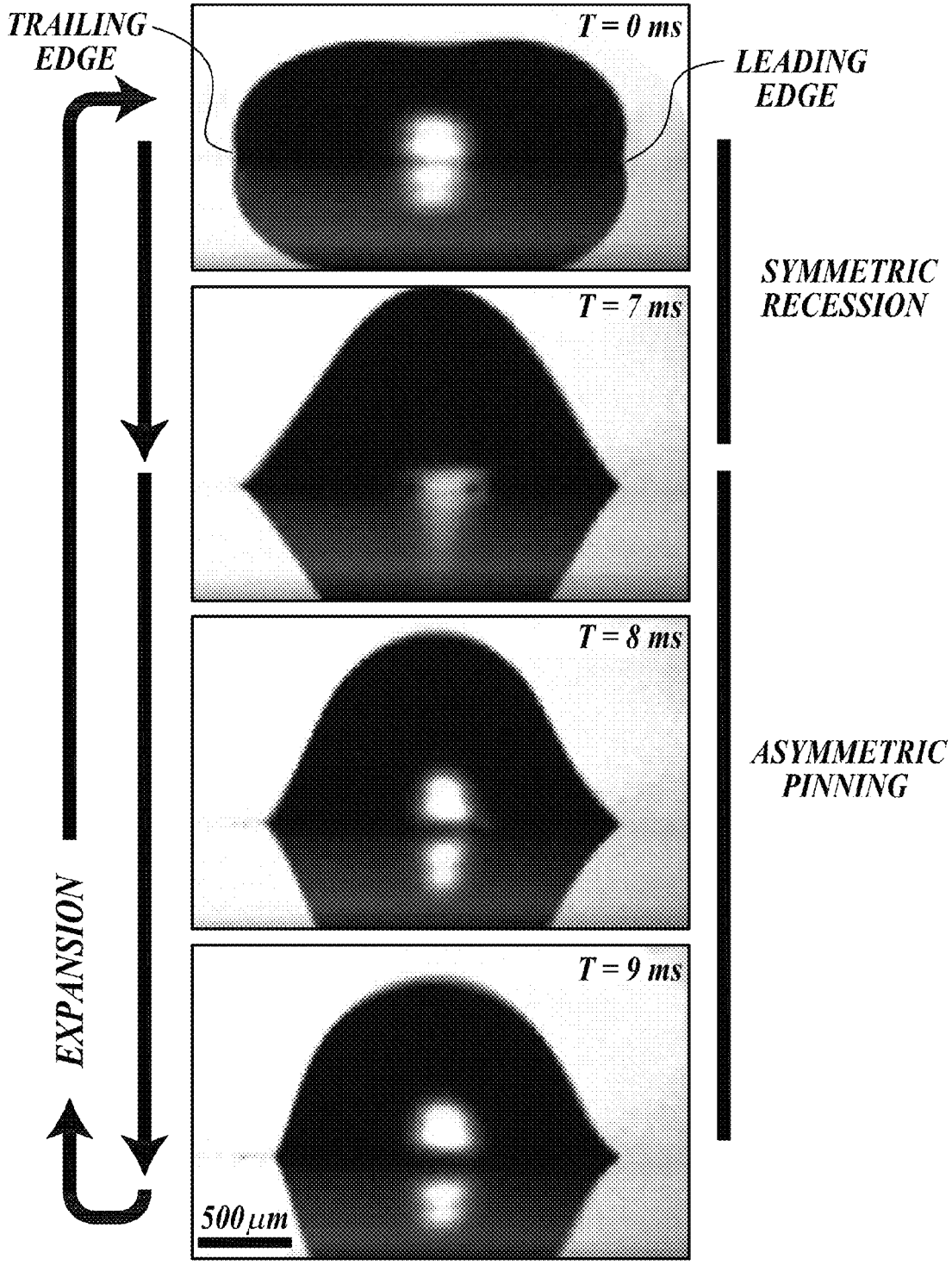
FIG. 12A is four frames from one period of oscillation resulting in directed transportation of a 12.5 μl drop on a TMS-FOTS wetting barrier ratchet captured by a high-speed camera as it moves from left to right with a velocity of 5.4 mm/s.
Figure 12B:
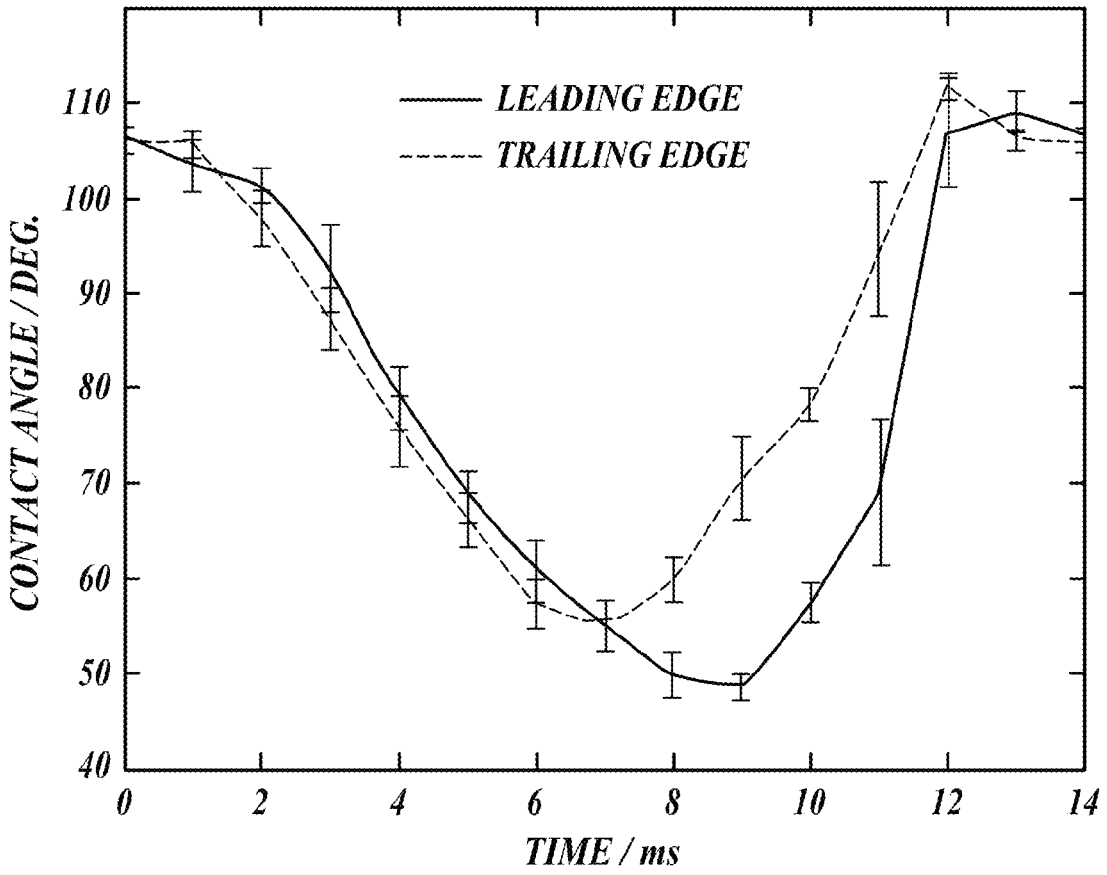
FIG. 12B is a graph of the mean contact angles of the droplet from FIG. 12A measured over time.

FIGS. 12A and 12B. Directed transportation of a 12.5 μl drop on a TMS-FOTS wetting barrier ratchet is captured by a high-speed camera as it moves from left to right with a velocity of 5.4 mm/s. Transport is actuated with a vibrational amplitude of 100 μm at 72 Hz. FIG. 12A: Four frames from one period of oscillation are displayed and FIG. 12B: the mean contact angles over eight periods are measured and plotted vs. time (the standard deviation at each time point is indicated). At 0 ms the footprint of the drop is at its maximum expansion just prior to recession. Initially, the edge of the drop recedes symmetrically from 0 to 7 ms. Asymmetric pinning is clearly visible from 7 to 9 ms, where the leading right edge of the drop pins to the surface while its contact angle decreases; simultaneously, the contact angle of the trailing left edge increases as it recedes, leaving a faint residue of water behind. See supporting information for videos of drop transport.

Actuation Amplitude

The minimum amplitude required to initiate transport, defined as the actuation amplitude, is limited by the pinning at the leading edge. Agitation must be significant enough to advance the leading edge of the drop by at least one rung before transport can take place. A geometric sharp edge, i.e., a discontinuity between solid and vapor, will in general result in stronger pinning than a chemical edge, i.e., a discontinuity between two surfaces with different wetting properties. Therefore, wetting barrier ratchets are expected to have lower actuation amplitudes than texture ratchets. Actuation amplitudes were measured on texture ratchets versus the two new wetting barrier ratchets with identical rung layouts. The results shown in FIG. 13 demonstrate that actuation amplitudes are significantly reduced on both wetting barrier ratchet designs. The most significant decrease was observed with a 10 μl drop, with a reduction of actuation amplitude from 133±7.5 μm on the texture ratchets to 37±2.3 μm on the TMS-FOTS ratchet. The TMS-FOTS ratchet performed slightly better than the TMS-dodecanethiol ratchet—this is not unexpected, as the 60 nm Au/Cr layer should increase pinning for the leading edge.

Figure 13:
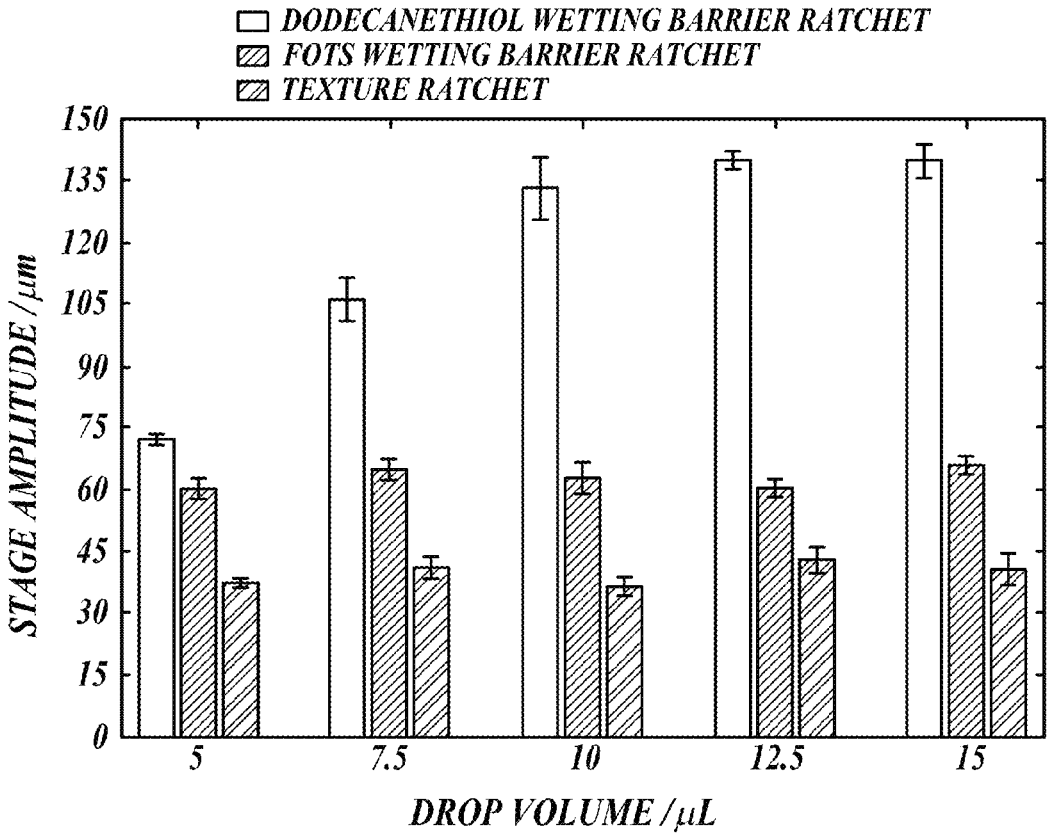
FIG. 13 is a graph comparing the actuation amplitudes required to initiate movement of devices of the present invention for various droplet volumes.

FIG. 13. Wetting barrier ratchets reduce actuation amplitudes required to initiate transport in comparison to the previously reported texture ratchet. Each device had identical rung layout and was actuated at its resonant frequency for the given ratchet and drop volume. They are listed in order of increasing volume [5, 7.5, 10, 12.5 and 15 μL]: texture ratchet [75, 60, 50, 45, and 42 Hz], FOTS-TMS ratchet [115, 95, 82, 72, and 65 Hz] and dodecanethiol—TMS ratchet [97, 85, 74, 67, and 61 Hz]. The FOTS design clearly outperformed both the texture ratchet and the dodecanethiol design. Error bars indicate the standard deviation of each set of measurements.

Slip Test

Figure 14A:
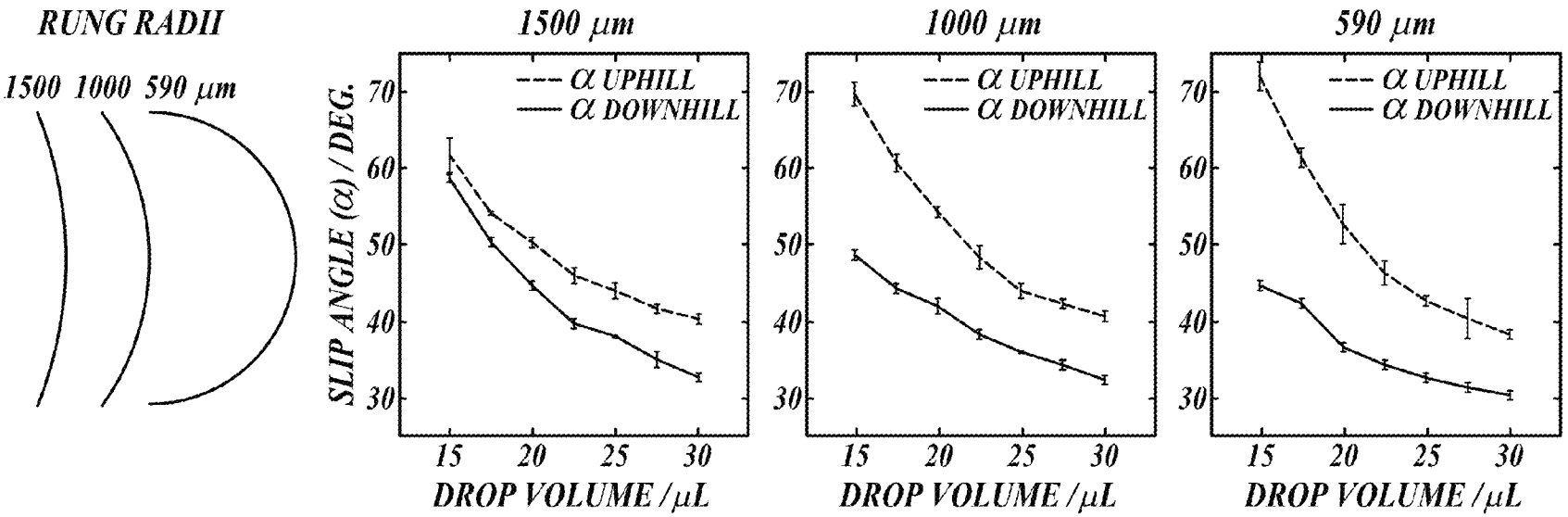
FIGS. 14A-14C: A slip test was utilized to determine the pinning forces for three exemplary device designs with rung radii 590 μm, 1000 μm and 1500 μm, for drop volumes ranging from 15 to 30 μL.
Figure 14B:
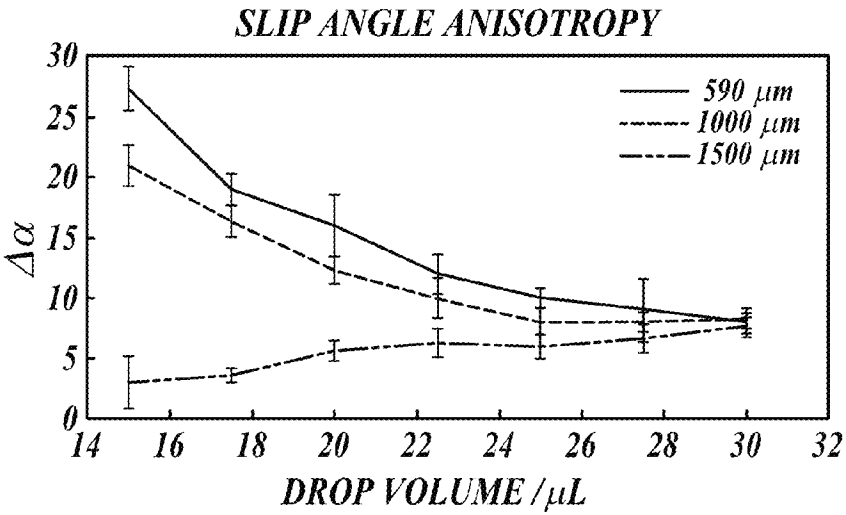
Figure 14C:
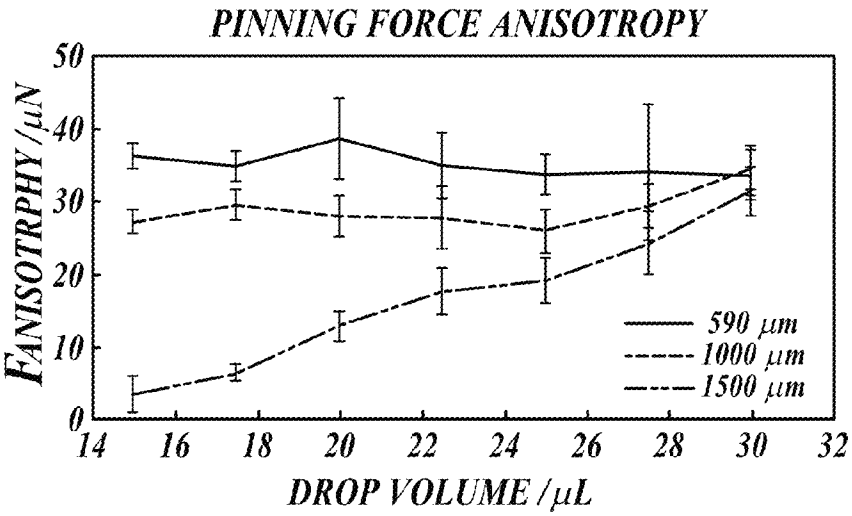

To evaluate experimentally how rung curvature affects pinning anisotropy a slip test was performed. A drop was placed on a TMS-FOTS ratchet mounted on a horizontal stage. The stage was slowly tilted upwards until a critical stage angle (α) was reached at which point the drop slid downhill off the substrate. The slip test was conducted for three rung radii: 590 μm, 1000 μm, and 1500 μm. Experimental results are shown in FIGS. 14A-14C for drops ranging in volume from 15 to 30 μL. The critical stage angle varies depending on the rung orientation (curvature pointing uphill or downhill). Both orientations were tested to find the force of anisotropy. To measure $F_{Anisotropy}$ the difference is taken between $F_{slip,uphill}$ and $F_{slip,downhill}$ in Equation 8.

$$F_{Anisotropy}=mg(\sin\alpha_{uphill}-\sin\alpha_{downhill}) \quad (8)$$

where m, g, $\alpha_{uphill}$ and $\alpha_{downhill}$ are the mass of the drop, acceleration due to gravity, critical stage angles for when rung curvature was pointed uphill or downhill, respectively. The difference in α, displayed in FIG. 14B, was largest for smaller radii and decreased as the radii increased. At 30 μL Δα converged for all ratchets to 8°. The convergence at high volumes can be explained as an indifference to rung curvature when the radius of the footprint was significantly greater than the rung radius. For a 15 μL drop $F_{Anisotropy}$ was 36.4±1.8 μN, 27.4±1.7 μN, and 3.8±2.6 μN for the 590 μm, 1000 μm and 1500 μm radii devices, respectively, demonstrating the increased anisotropy for the tested ratchets with smaller rung radii and indicating that they should have superior ratcheting performance.

FIGS. 14A-14C. A slip test was utilized to determine the pinning forces for three ratchet designs with rung radii 590 μm, 1000 μm and 1500 μm, for drop volumes ranging from 15 to 30 μL. FIG. 14A: The critical stage angle, α, for each track design is plotted for the rung curvature pointing uphill and downhill, respectively. FIG. 14B: The difference in α for the rung curvature uphill and downhill experiment is plotted for each track design. FIG. 14C: Pinning anisotropy (Equation 8) was plotted for each track design. The 590 μm device, complete semi-circle, demonstrated the strongest anisotropy.

Ratchet Performance vs. Rung Curvature

As predicted by the slip test, the TMS-FOTS ratchet with a 590 μm rung radius outperformed the others in terms of minimizing actuation amplitude and maximizing transport velocity. Actuation amplitudes were evaluated over the same set of devices with their results from the slip test for 15 and 20 μL drops in FIGS. 15A and 15B. For a 15 μL drop, actuation amplitudes were found to be 79.5±1.3 μm, 108.0±6.0 μm, and 158.3±3.4 μm for the 590 μm, 1000 μm, and 1500 μm devices, respectively. Not only did smaller rung radii result in transport at lower actuation amplitudes, but even at lower actuation amplitudes drops were transported faster. Velocities at actuation were measured to be 4.22±0.15 mm/s, 2.4±0.08 mm/s, and 1.98±0.04 mm/s for the 590 μm, 1000 μm, and 1500 μm radii, respectively.

The increased force of anisotropy and improved ratchet performance for devices with shorter rung radii suggests a relationship between boundary morphology and pinning strength. To our knowledge, there has not been a comprehensive study directly investigating the issue of boundary curvature and pinning. Several independent investigations have been conducted on the two extremes: circular hydrophilic domain (high curvature) and straight hydrophilic stripe (no curvature). For the circular hydrophilic domain case TPL advancement occurred when $\theta_b=\theta_2$. In the hydrophilic stripe case, TPL advancement was observed at $\theta_b<\theta_2$. While a more extensive study is required to fully understand the boundary curvature's role in pinning, these studies support our experimental observations that a higher rung curvature increases pinning anisotropy and ratchet performance.

Figure 15A:
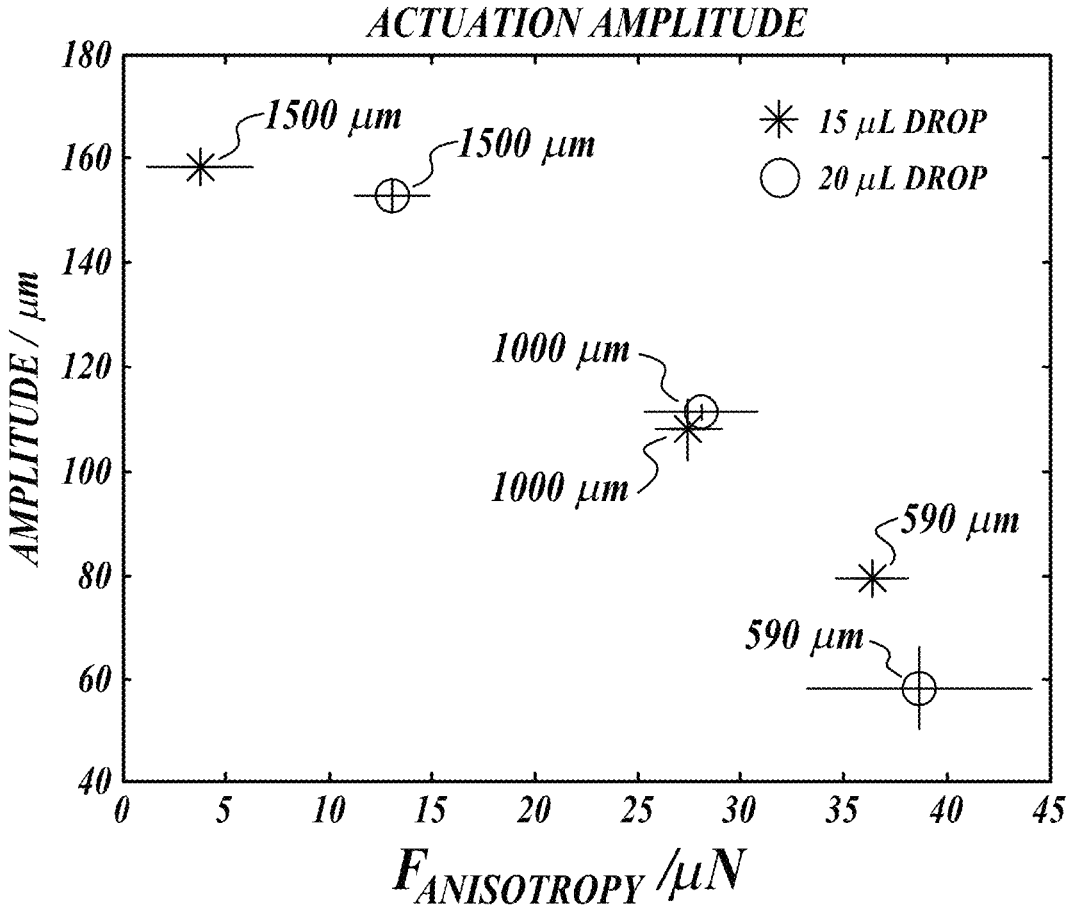
FIG. 15A is a graph of actuation amplitudes for three exemplary track designs compared to $F_{Anisotropy}$ measured in the slip test.
Figure 15B:
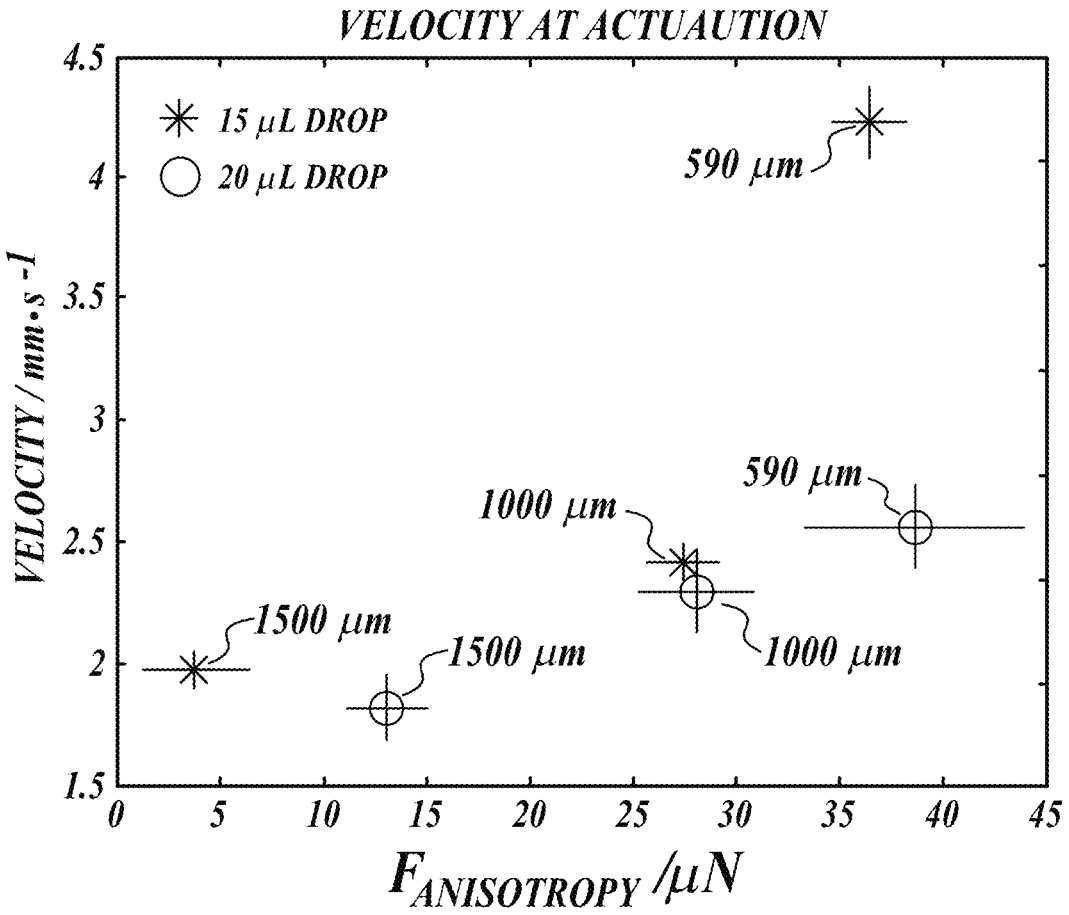
FIG. 15B is a graph of drop velocity for three exemplary track designs compared to $F_{Anisotropy}$ measured in the slip test.

FIGS. 15A and 15B. Actuation amplitudes for three track designs were compared to $F_{Anisotropy}$ measured in the slip test for 15 μL and 20 μL drops at 74 Hz and 66 Hz, respectively. FIG. 15A: As the rung radius decreases from 1500 μm to 590 μm the actuation amplitude decreases by factors 2 or 2.8 and $F_{Anisotropy}$ increases by factors 9.5 or 2.8 for the 15 μL or 20 μL volume, respectively. FIG. 15B: At actuation, the drop velocity is faster on the smaller rung radius despite the lower actuation amplitude. The horizontal line of the cross represents the standard deviation for $F_{Anisotropy}$ while the vertical line of the cross represents the standard deviation for the actuation amplitude or velocity.

CONCLUSION

We realize a novel digital microfluidic platform. The wetting barrier ratchet implements a purely chemical pawl made of periodic semi-circular hydrophilic rungs on a hydrophobic background. Wetting barrier ratchets reduce the actuation amplitudes of previously reported texture ratchets more than three-fold for a 10 μL drop. They can be optically flat, making fully transparent devices possible. The chemical pattern can be simply fabricated in a number of ways, including techniques compatible with cheap mass production (e.g., inkjet or contact printing). The flat surface is easily cleaned, integrated with electrodes and sensors and is compatible for downscaling to nanoscale features for improved performance.

For the first time, we use the line fraction CB equation to provide a theoretical foundation for describing how periodic curved rungs induce anisotropic contact angle hysteresis and drop transport. Experimentally determined pinning anisotropy is shown to be positively related to ratcheting performance in terms of minimizing the actuation amplitude while maximizing transport velocities. The smallest rung radius investigated, 590 μm, a complete semi-circle had the best ratcheting performance.

The wetting barrier ratchet provides a simple and cheap platform for performing drop based chemical or biological microfluidic functions. It could be implemented in a low-power DMF point-of-care technology, or alternatively as a laboratory tool easily integrated with inverted microscopy due to its transparency. Other potential applications include condensation collection on windows or for applications in cooling or desalination.

While illustrative embodiments have been illustrated and described, it will be appreciated that various changes can be made therein without departing from the spirit and scope of the invention.

The embodiments of the invention in which an exclusive property or privilege is claimed are defined as follows:

1. A method of moving a droplet along a predetermined path on a surface, the method comprising: providing the surface having an elongated track comprising a plurality of transverse arcuate regions having a different degree of hydrophobicity than the surface, wherein the transverse arcuate regions are sized and spaced to induce asymmetric contact angle hysteresis between the droplet and the surface when the droplet is vibrated; depositing the droplet on the elongated track; and vibrating the surface at a frequency and amplitude sufficient to cause the droplet to deform such that a front portion of the supported droplet contacts an at least one additional transverse arcuate region, thereby urging the droplet towards the at least one additional transverse arcuate region.

2. The method of claim 1, wherein the plurality of transverse arcuate regions and the surface are optically flat.

3. The method of claim 1, wherein the plurality of transverse arcuate regions and the surface are coplanar.

4. The method of claim 1, wherein the plurality of transverse arcuate regions and the surface are formed from the same substrate.

5. The method of claim 1, wherein the amplitude is from 1 micron to 1 mm.

6. The method of claim 1, wherein the frequency is from 1 Hz to 1 kHz.

7. The method of claim 1, wherein the elongated track defines a closed loop.

8. The method of claim 1, wherein the step of vibrating the surface comprises a technique selected from the group consisting of acoustic vibration, electromagnetic vibration, and piezoelectric vibration.

9. The method of claim 1, wherein the transverse arcuate regions have a width from 1 nm to 1 mm.

10. The method of claim 1, wherein the transverse arcuate regions define substantially circular arcs having a constant radius.

11. The method of claim 10, wherein the constant radius is approximately equal to a radius of a footprint of the droplet.

12. The method of claim 10, wherein the substantially circular arcs are equal to or less than ½ of a circle.

13. The method of claim 1, wherein the step of depositing the droplet on the elongated track occurs without any external vibration.

14. The method of claim 1, wherein the step of depositing the droplet on the elongated track occurs via condensation on the elongated track.

15. The method of claim 1, wherein the plurality of transverse arcuate regions and the surface are transparent at visible wavelengths.

16. The method of claim 1, wherein the plurality of transverse arcuate regions are more hydrophobic than the surface.

17. The method of claim 1, wherein the plurality of transverse arcuate regions are more hydrophilic than the surface.

18. The method of claim 1, wherein the droplet has a degree of hydrophobicity closer to the degree of hydrophobicity of the transverse arcuate regions than that of the surface.

19. A device for moving a droplet along a predetermined path on a surface, comprising: the surface having an elongated track comprising a plurality of transverse arcuate regions having a different degree of hydrophobicity than the surface, wherein the transverse arcuate regions are sized and spaced to induce asymmetric contact angle hysteresis between the droplet and the surface when the droplet is vibrated; and a means for vibrating the surface at a frequency and amplitude sufficient to cause the droplet to deform such that the front portion of the droplet contacts at least one additional transverse arcuate region, thereby urging the droplet towards the at least one additional transverse arcuate region.

20. The device of claim 19, wherein the plurality of transverse arcuate regions and the surface are optically flat.

21. The device of claim 19, wherein the plurality of transverse arcuate regions and the surface are coplanar.

22. The device of claim 19, wherein the plurality of transverse arcuate regions and the surface are formed from the same substrate.

23. The device of claim 19, wherein the amplitude is from 1 micron to 1 mm.

24. The device of claim 19, wherein the frequency is from 1 Hz to 1 kHz.

25. The device of claim 19, wherein the elongated track defines a closed loop.

26. The device of claim 19, wherein the means for vibrating the surface comprises a technique selected from the group consisting of acoustic vibration, electromagnetic vibration, and piezoelectric vibration.

27. The device of claim 19, wherein the transverse arcuate regions have a width from 1 nm to 1 mm.

28. The device of claim 19, wherein the transverse arcuate regions define substantially circular arcs having a constant radius.

29. The method of claim 28, wherein the constant radius is approximately equal to a radius of a footprint of the droplet.

30. The method of claim 28, wherein the substantially circular arcs are equal to or less than ½ of a circle.

31. The device of claim 19, wherein the plurality of transverse arcuate regions and the surface are transparent at visible wavelengths.

32. The device of claim 19, wherein the plurality of transverse arcuate regions are more hydrophobic than the surface.

33. The device of claim 19, wherein the plurality of transverse arcuate regions are more hydrophilic than the surface.

34. The device of claim 19, wherein the droplet has a degree of hydrophobicity closer to the degree of hydrophobicity of the transverse arcuate regions than that of the surface.

* * * * *